US009659699B2

(12) United States Patent
Choi

(10) Patent No.: US 9,659,699 B2
(45) **Date of Patent: *May 23, 2017**

(54) MAGNETIC SUBSTANCE HOLDING DEVICE MINIMALIZING RESIDUAL MAGNETISM

(71) Applicant: Tae Kwang Choi, Gwangmyeong-si (KR)

(72) Inventor: Tae Kwang Choi, Gwangmyeong-si (KR)

( * ) Notice: Subject to any disclaimer, the term of this patent is extended or adjusted under 35 U.S.C. 154(b) by 39 days.

This patent is subject to a terminal disclaimer.

(21) Appl. No.: 14/630,316

(22) Filed: Feb. 24, 2015

(65) Prior Publication Data

US 2015/0287510 A1 Oct. 8, 2015

(30) Foreign Application Priority Data

Apr. 8, 2014 (KR) ..... 10-2014-0042044

(51) Int. Cl.

| | |
|---|---|
| ***H01F 7/20*** | (2006.01) |
| ***H01F 3/00*** | (2006.01) |
| ***H01F 7/06*** | (2006.01) |
| ***H01F 7/04*** | (2006.01) |

(52) U.S. Cl.

CPC ..... *H01F 7/206* (2013.01); *H01F 3/00* (2013.01); *H01F 7/04* (2013.01); *H01F 7/064* (2013.01); *H01F 2007/208* (2013.01)

(58) Field of Classification Search

CPC ... H01F 3/00; H01F 7/04; H01F 7/064; H01F 7/206; H01F 2007/208

USPC ..... 361/145

See application file for complete search history.

(56) References Cited

U.S. PATENT DOCUMENTS

| | | | | |
|---|---|---|---|---|
| 4,594,568 A * | 6/1986 | Hubner | ..... | B23Q 3/1546 335/289 |
| 4,956,625 A * | 9/1990 | Cardone | ..... | B23Q 3/1546 335/290 |
| 2014/0361860 A1 | 12/2014 | Choi | | |

FOREIGN PATENT DOCUMENTS

| | | |
|---|---|---|
| KR | 20110087931 A | 8/2011 |
| KR | 20120130040 A | 11/2012 |
| KR | 101319052 A | 10/2013 |

* cited by examiner

*Primary Examiner* — Thienvu Tran
*Assistant Examiner* — Kevin J Comber
(74) *Attorney, Agent, or Firm* — AEON Law; Adam L. K. Philipp; Manasi Vakil

(57) ABSTRACT

Disclosed herein is a magnetic substance holding device that minimizes residual magnetism by way of employing structures for minimizing reluctance to magnetic flux flow.

13 Claims, 12 Drawing Sheets

【fig. 6A】
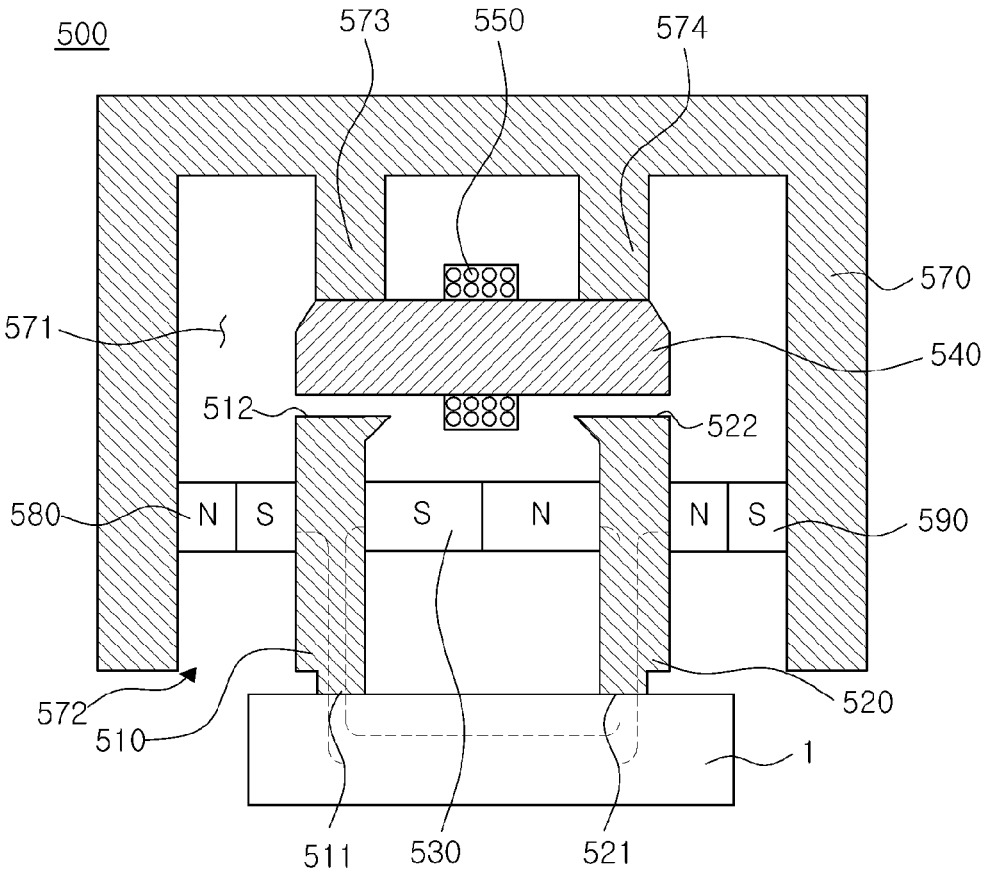

【fig. 6B】
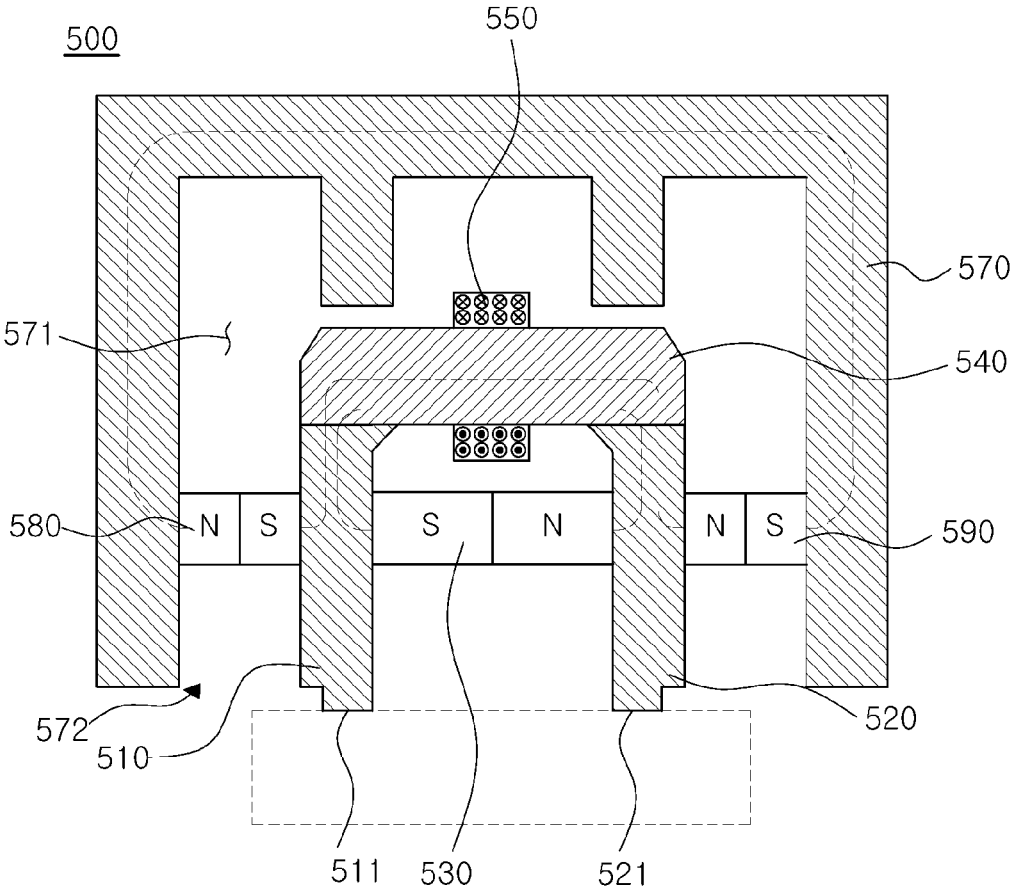

MAGNETIC SUBSTANCE HOLDING DEVICE MINIMALIZING RESIDUAL MAGNETISM

CROSS-REFERENCE TO RELATED APPLICATIONS

This application claims the priority of Korean Patent Application No. 10-2014-0042044 filed on Apr. 8, 2014, in the Korean Intellectual Property Office, the disclosure of which is incorporated herein by reference.

BACKGROUND OF THE INVENTION

Field of the Invention

The present invention relates to a magnetic substance holding device, and more particularly to a magnetic substance holding device that controls magnetic fluxes from permanent magnets to thereby obtain strong holding force, to easily switch between holding and detaching, and to minimize residual magnetism.

Description of the Related Art

A magnetic substance holding device such as a permanent magnet workholding device is used to attach thereto a workpiece made of a magnetic material such as iron using magnetic force. Nowadays, such a magnetic substance holding device is widely used as an internal device attached to a mold clamping unit of an injection molding machine, a mold clamping unit of a press machine, a chuck of a machine tool, and so on.

The basic principle of such a magnetic substance holding device is that it attaches a magnetic workpiece to a holding face using strong magnetic force from a permanent magnet, and detaches the magnetic workpiece from the holding face by controlling the magnetic flux from the permanent magnet so that no magnetic flux flows through the holding face.

The method for controlling the magnetic flux from the permanent magnet may include rotating another permanent magnet which is rotatably installed to control the magnetic flux, employing an additional electromagnet to control the magnet flux, or the like.

The applicant of the present invention has already proposed a magnetic substance holding device employing an additional electromagnet (see International Publication No. WO 2012/039548). In addition, the applicant of the present invention has proposed an improved magnetic substance holding device (see Korean Patent No. 1319052).

The magnetic substance holding device disclosed in the Korean Patent No. 1319052 to the applicant of the present invention includes coils around pole pieces instead of an additional electromagnet, and accordingly has advantages in that strong holding force can be obtained in a simple structure, magnetic force from a permanent magnet can be controlled with small current at the time of switching between holding and detaching, and strong holding force can be obtained in a smaller space.

However, there is still a challenge for such a magnet substance holding device to minimize residual magnetism that attracts a workpiece even after it is detached. The magnetic substance holding devices disclosed in the above references could have reduced residual magnetism, compared to existing magnetic substance holding devices. However, in order to increase utilization of such magnetic substance holding devices, residual magnetism has to be further reduced.

SUMMARY OF THE INVENTION

In view of the above, an object of the present invention is to provide a magnetic substance holding device that minimizes residual magnetism by means of structures for minimizing reluctance to magnetic flux flow.

It should be noted that objects of the present invention are not limited to the above-described object, and other objects of the present invention will be apparent to those skilled in the art from the following descriptions.

According to an aspect of the present invention, there is provided a magnetic substance holding device that holds a workpiece thereon and detaches it therefrom. The device comprises: a first pole piece having a holding face on which the workpiece is attached and a base-attaching face at different portion from the holding face, the first pole piece being a magnetic substance; a second pole piece having a holding face on which the workpiece is attached and a base-attaching face at different portion from the holding face, the second pole piece being a magnetic substance; a primary permanent magnet disposed so that its N-pole comes in contact with one of the first pole piece and the second pole piece while its S-pole comes in contact with the other of the first pole piece and the second pole piece; a base movable between a first location and a second location, the base being spaced apart from at least one of the base-attaching face of the first pole piece and the base-attaching face of the second pole piece at the first location while the base being in contact with both of the base-attaching face of the first pole piece and the base-attaching face of the second pole piece at the second location; at least one coil wound around at least one of the first pole piece, the second pole piece and the base; and a control device controlling electric current applied to the coil to magnetize at least one of the first pole piece, the second pole piece and the base, thereby controlling holding or detaching of the workpiece. Upon the base being placed at the first location, the workpiece may be attached on the holding faces of the first and second pole pieces. Upon applying electric current to the coil to create magnetic flux flow passing through the base-attaching face of the first pole piece and the base-attaching face of the second pole piece, the base may be placed at the second location by magnetic force, so that the workpiece is detached from the holding faces of the first and second pole pieces. A flow-promoting portion may be formed near a region where the first pole piece meets the base or a region where the second pole piece meets the base so that when the base is at the second location, the shortest one of magnetic flux paths induced by the primary permanent magnet and passing through the base is not bent at a right angle. Corners of the base may be chamfered or filleted for conforming to magnetic flux path induced by the primary permanent magnet and passing though the base when the base is at the second location.

The device may further comprise: a third pole piece having a holding face on which the workpiece is attached and a base-attaching face at different portion from the holding face, the third pole piece being a magnetic substance; and an auxiliary permanent magnet disposed so that its one pole of the same polarity as that of the primary permanent magnet in contact with second pole piece is in contact with the second pole piece while its other pole is in contact with the third pole piece. The first location of the base may refer to a location where at least two of the base-attaching face of the first pole piece, the base-attaching face of the second pole piece and the base-attaching face of the third pole piece are spaced apart from the base. The second location of the base may refer to a location where all of the base-attaching face of the first pole piece, the base-attaching face of the second pole piece and the base-attaching face of the third pole piece come in contact with the base. The at least one coil may be wound around at least the second pole piece. Upon the base being placed at the first location, the workpiece may be attached on the holding faces of the first, second and third pole pieces. Upon applying electric current to the coil to create magnetic flux flow passing through the base-attaching face of the first pole piece, the base-attaching face of the second pole piece and the base-attaching face of the third pole piece, the base may be placed at the second location by magnetic force, so that the workpiece is detached from the holding faces of the first, second and third pole pieces. A flow-promoting portion may be formed near a region where the third pole piece meets the base so that when the base is at the second location, the shortest one of magnetic flux paths induced by the primary permanent magnet and the auxiliary permanent magnet and passing through the base is not bent at a right angle. Corners of the base may be chamfered or filleted for conforming to magnetic flux path induced by the primary permanent magnet and the auxiliary permanent magnet and passing though the base when the base is at the second location.

The device may further comprise: a third pole piece having a holding face on which the workpiece is attached and a base-attaching face at different portion from the holding face, the third pole piece facing the second pole piece while being spaced apart therefrom, and being a magnetic substance; a fourth pole piece having a holding face on which the workpiece is attached and a base-attaching face at different portion from the holding face; and an auxiliary permanent magnet disposed so that its one pole of the same polarity as that of the primary permanent magnet in contact with second pole piece is in contact with the third pole piece while its other pole is in contact with the fourth pole piece. The first location of the base may refer to a location where at least three of the base-attaching face of the first pole piece, the base-attaching face of the second pole piece, the base-attaching face of the third pole piece and the base-attaching face of the fourth pole piece are spaced apart from the base. The second location of the base may refer to a location where all of the base-attaching face of the first pole piece, the base-attaching face of the second pole piece, the base-attaching face of the third pole piece and the base-attaching face of the fourth pole piece come in contact with the base. The coil may be wound around at least the second pole piece and the third pole piece together. Upon the base being placed at the first location, the workpiece may be attached on the holding faces of the first, second, third and fourth pole pieces. Upon applying electric current to the coil to create magnetic flux flow passing through the base-attaching face of the first pole piece, the base-attaching face of the second pole piece, the base-attaching face of the third pole piece and the base-attaching face of the fourth pole piece, the base may be placed at the second location by magnetic force, so that the workpiece is detached from the holding faces of the first, second, third and fourth pole pieces. A flow-promoting portion may be formed near a region where the third pole piece meets the base or a region where the fourth pole piece meets the base so that when the base is at the second location, the shortest one of magnetic flux paths induced by the primary permanent magnet and the auxiliary permanent magnet and passing through the base is not bent at a right angle. Corners of the base may be chamfered or filleted for conforming to magnetic flux path induced by the primary permanent magnet and the auxiliary permanent magnet and passing though the base when the base is at the second location.

The device may further comprise: a yoke having an accommodation space therein and an opening, the yoke being a magnetic substance; a first auxiliary permanent magnet disposed so that its one pole of the same polarity as that of the primary permanent magnet in contact with the first pole piece is in contact with the first pole piece while its other pole is in contact with the yoke; a second auxiliary permanent magnet disposed so that its one pole of the same polarity as that of the primary permanent magnet in contact with the second pole piece is in contact with the second pole piece while its other pole is in contact with the yoke. At least a part of each of the base, the first pole piece and the second pole piece may be accommodated in the accommodation space of the yoke while being spaced apart from the yoke. The holding faces of the first pole piece and the second pole piece may be exposed to the outside through the opening.

The device may further comprise: a yoke having an accommodation space therein and an opening, the yoke being a magnetic substance; a first auxiliary permanent magnet disposed so that its one pole of the same polarity as that of the primary permanent magnet in contact with the first pole piece is in contact with the first pole piece while its other pole is in contact with the yoke; a second auxiliary permanent magnet disposed so that its one pole of the same polarity as that of the primary permanent magnet in contact with the second pole piece is in contact with the second pole piece while its other pole is in contact with the yoke. At least a part of each of the base, the first pole piece and the second pole piece may be accommodated in the accommodation space of the yoke while the first pole piece and the second pole piece are spaced apart from the yoke. The base may be spaced apart from the yoke when it is at the second location. The base may be spaced apart from both of the base-attaching face of the first pole piece and the base-attaching face of the second pole piece but is in contact with the yoke. The holding faces of the first pole piece and the second pole piece may be exposed to the outside through the opening.

The yoke may comprise a bottom plate and side plates spaced apart from the bottom plate, and the first auxiliary permanent magnet and the second auxiliary permanent magnet may be in contact with the side plates. The bottom plate may have first and second projections protruding therefrom toward the accommodation space. A third auxiliary permanent magnet may be disposed between the first projection and one of the side plates so that its one pole of the opposite polarity to that of the first auxiliary permanent magnet in contact with first pole piece is in contact with the first projection while its other pole of the same polarity as that of the first auxiliary permanent magnet in contact with the first pole piece is in contact with the side plate. A fourth auxiliary permanent magnet may be disposed between the second projection and the other one of the side plates so that its one pole of the opposite polarity to that of the second auxiliary permanent magnet in contact with second pole piece is in contact with the second projection while its other pole of the same polarity as that of the second auxiliary permanent magnet in contact with the second pole piece is in contact with the side plate.

The device may further comprise: a yoke having an accommodation space therein and at least two openings, the yoke being a magnetic substance; a third pole piece having a holding face on which a different workpiece from the workpiece is attached and a base-attaching face at different portion from the holding face, the third pole piece being a magnetic substance; a fourth pole piece having a holding face on which the different workpiece from the workpiece is attached and a base-attaching face at different portion from the holding face, the fourth pole piece being a magnetic substance; a first auxiliary permanent magnet disposed so that its one pole of the same polarity as that of the primary permanent magnet in contact with the first pole piece is in contact with the first pole piece while its other pole is in contact with the yoke; a second auxiliary permanent magnet disposed so that its one pole of the same polarity as that of the primary permanent magnet in contact with the second pole piece is in contact with the second pole piece while its other pole is in contact with the yoke; a third auxiliary permanent magnet disposed so that its one pole of the same polarity as that of the primary permanent magnet in contact with the second pole piece is in contact with the third pole piece while its other pole is in contact with the fourth pole piece; a fourth auxiliary permanent magnet disposed so that its one pole of the same polarity as that of the third auxiliary permanent magnet in contact with the third pole piece is in contact with the third pole piece while its other pole is in contact with the yoke; and a fifth auxiliary permanent magnet disposed so that its one pole of the same polarity as that of the third auxiliary permanent magnet in contact with the fourth pole piece is in contact with the fourth pole piece while its other pole is in contact with the yoke. At least a part of each of the base, the first pole piece, the second pole piece, the third pole piece and the fourth pole piece may be accommodated in the accommodation space of the yoke while being spaced apart from the yoke. The holding faces of the first pole piece and the second pole piece may be exposed to the outside through one of the openings, and the holding faces of the third pole piece and the fourth pole piece are exposed to the outside through the other one of the openings. The first location of the base may refer to a location where both the base-attaching face of the first pole piece and the base-attaching face of the second pole piece are spaced apart from the base whereas both of the base-attaching face of the third pole piece and the base-attaching face of the fourth pole piece come in contact the base. The second location of the base may refer to a location where both of the base-attaching face of the third pole piece and the base-attaching face of the fourth pole piece are spaced apart from the base.

An area of the holding face of the first pole piece may be smaller than an average of the cross-sectional areas of the portion where the primary permanent magnet faces the first pole piece. An area of the holding face of the second pole piece may be smaller than an average of the cross-sectional areas of the portion where the primary permanent magnet faces the second pole piece.

The second pole piece may be in a plate-like shape having a relatively large first face and a second face. The primary permanent magnet may come in contact with the first face and the coil may be wound around between the primary permanent magnet and the holding face. When the second pole piece is disposed such that the upper face of the second pole piece is the base-attaching face and the lower face thereof is the holding face, from a point of view perpendicular to the first face, a horizontal width of the portion where the coil is wound may be smaller than a horizontal width of the base-attaching face, and a horizontal width of the holding face may be smaller than the horizontal width of the portion where the coil is wound.

An average of cross-sectional areas of the base in a longitudinal direction may be larger than an average of cross-sectional area of the portion where the primary permanent magnet faces the first pole piece, and larger than an average of the cross-sectional area of the portion where the primary permanent magnet faces the second pole piece.

The device may further comprise: elastic means for providing elastic force to push the base away from the first pole piece and the second pole piece.

The coil may be wound around the first pole piece or the second pole piece and may be disposed between the primary permanent magnet and the holding face.

The coil may be wound around the base.

According to the magnetic substance holding device of the present invention, residual magnetism when a workpiece has been detached therefrom can be minimized. In addition, by disposing coils around pole pieces instead of an additional electromagnet, strong holding force can be obtained in a simple structure, magnetic force from a permanent magnet can be controlled with small current at the time of switching between holding and detaching, and strong holding force can be obtained in a smaller space.

BRIEF DESCRIPTION OF THE DRAWINGS

The above and other aspects, features and other advantages of the present invention will be more clearly understood from the following detailed description taken in conjunction with the accompanying drawings, in which:

FIGS. 6A and 6B are schematic cross-sectional views of a magnetic substance holding device according to still another exemplary embodiment of the present invention;

DETAILED DESCRIPTION OF THE PREFERRED EMBODIMENT

Figure 1A:
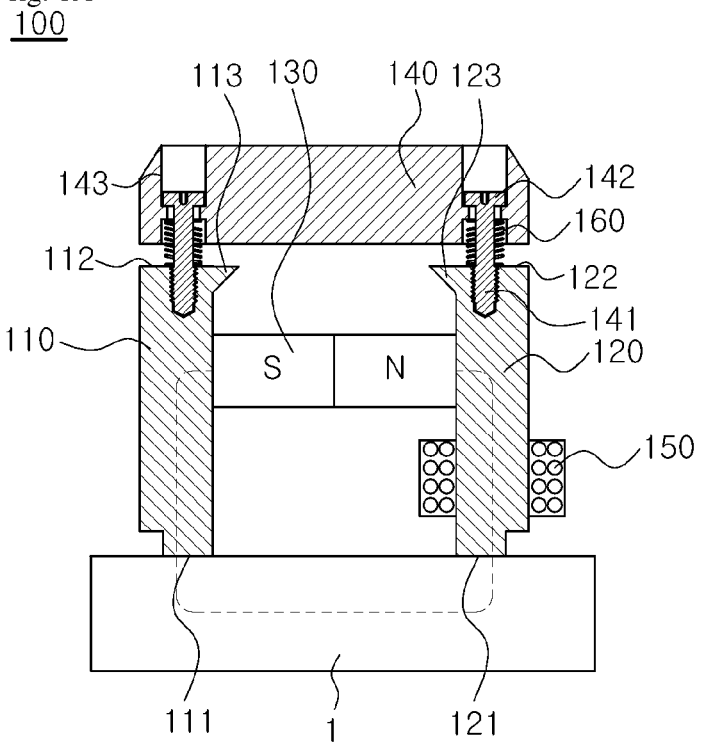
FIGS. 1A and 1B are schematic cross-sectional views of a magnetic substance holding device according to an exemplary embodiment of the present invention.

Advantages and features of the present invention and methods to achieve them will become apparent from the descriptions of exemplary embodiments herein below with reference to the accompanying drawings. However, the present invention is not limited to exemplary embodiments disclosed herein but may be implemented in various different ways. The exemplary embodiments are provided for making the disclosure of the present invention thorough and for fully conveying the scope of the present invention to those skilled in the art. It is to be noted that the scope of the present invention is defined only by the claims.

As used herein, a phrase "an element A on an element B" refers to that the element A may be disposed directly on the element B and/or the element A may be disposed indirectly on the element B via another element C.

Although terms such as first, second, etc. are used to distinguish arbitrarily between the elements such terms describe and these terms are not necessarily intended to indicate temporal or other prioritization of such elements. Theses terms are used to merely distinguish one element from another. Accordingly, as used herein, a first element may be a second element within the technical scope of the present invention.

Like reference numerals denote like elements throughout the descriptions.

The drawings are not to scale and the relative dimensions of various elements in the drawings are depicted schematically and not necessarily to scale.

Features of various exemplary embodiments of the present invention may be combined partially or totally. As will be clearly appreciated by those skilled in the art, technically various interactions and operations are possible. Various exemplary embodiments can be practiced individually or in combination.

Hereinafter, magnetic substance holding devices according to exemplary embodiments of the present invention will be described with reference to the accompanying drawings.

Figure 1B:
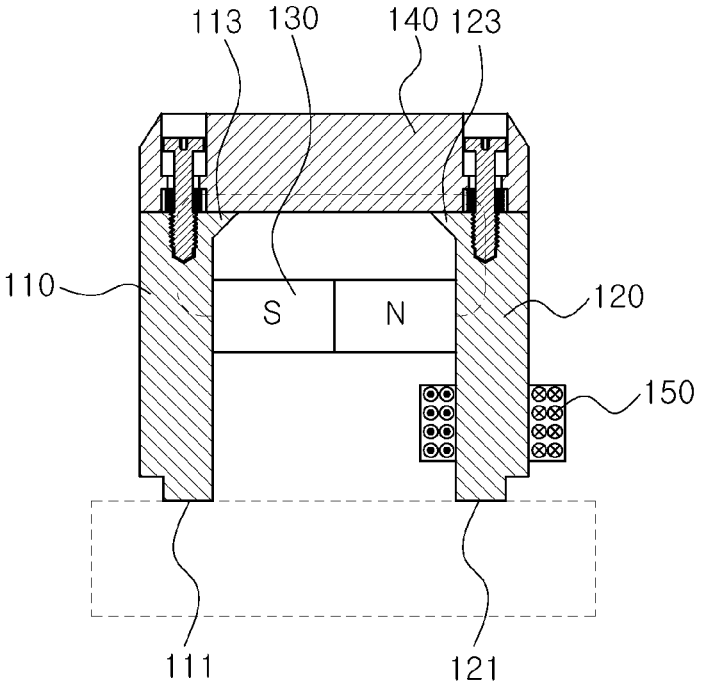
Figure 2:
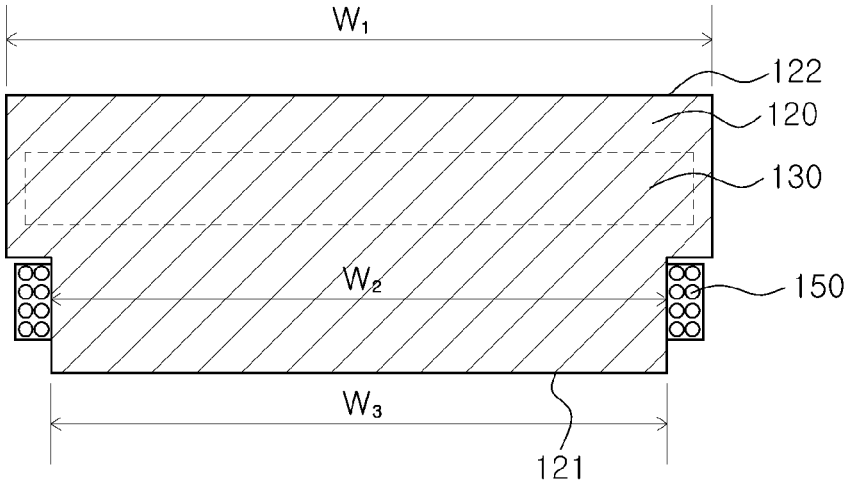
FIG. 2 is a side cross-sectional view of the base shown in FIG. 1A.

FIGS. 1A and 1B are schematic cross-sectional views of a magnetic substance holding device according to an exemplary embodiment of the present invention. Specifically, FIG. 1A is a schematic cross-sectional view of the magnetic substance holding device when it holds a workpiece, whereas FIG. 1B is a schematic cross-sectional view of the magnetic substance holding device when a workpiece is detached therefrom. FIG. 2 is a side cross-sectional view of the base shown in FIG. 1A.

A configuration of a magnetic substance holding device 100 according to an exemplary embodiment of the present invention will be described with reference to FIGS. 1A and 1B.

Referring to FIGS. 1A and 1B, a magnetic substance holding device 100 according to an exemplary embodiment includes a first pole piece 110, a second pole piece 120, a primary permanent magnet 130, a base 140, a coil 150, springs 160, and a control device (not shown).

The first pole piece 110 has a holding face 111 on which a workpiece 1, which is a magnetic substance, is to be attached, and a base-attaching face 112 on the opposite end to the holding face 111. The first pole piece 110 is made of a magnetic substance.

The second pole piece 120 has a holding face 121 on which a workpiece 1, which is a magnetic substance, is to be attached, and a base-attaching face 122 on the opposite end to the holding face 121. The second pole piece 120 is made of a magnetic substance.

The primary permanent magnet 130 is interposed between the first pole piece 120 and the second pole piece 130. The N-pole of the primary permanent magnet 130 is in contact with the first pole piece 110 or the second pole piece 120 while the S-pole thereof comes in contact with the second pole piece 120 or the first pole piece 110. In this exemplary embodiment, the N-pole is in contact with the second pole piece 120. A variety of permanent magnets may be employed as the primary permanent magnet 130, and the number or shape thereof may be selected as required.

The base 140 is made of a magnetic substance and is movable vertically between a first location (the location of FIG. 1A) at which the base 140 is not in contact with at least one of the base-attaching face 112 of the first pole piece 110 and the base-attaching face 122 of the second pole piece 120 and a second location (the location of FIG. 1B) at which the base 140 comes in contact with both of the base-attaching face 112 of the first pole piece 110 and the base-attaching face 122 of the second pole piece 120.

Referring to FIGS. 1A and 1B, the base 140 is guided by bolts 141 that penetrate the base 130 to be fastened to the first pole piece 110 and the second pole piece 120, respectively, such that the base 140 slides up and down. Springs 160, elastic means which will be described in detail below, push up the base 140. Counter-bores 143 are formed in the base 140 so that the separation distance from the first pole piece 110 and the second pole piece 120 is restricted by the heads 142 of the bolts 141 even if the base 140 is pushed up by the springs 160.

The coil 150 may be wound around at least one of the first pole piece 110, the second pole piece 120 and the base 140. In this exemplary embodiment, the coil 150 is wound around the second pole piece 120. However, this is merely illustrative, and the coil 150 may be wound around only the first pole piece 110 or the base 140, or coils may be wound around both of the first pole piece 120 and the second pole piece 130. In addition, the coil 150 may be wound around a pole piece at a position higher or lower than the primary permanent magnet 130.

Preferably, the coil 150 is disposed between the primary permanent magnet 130 and the holding face 121 of the second pole piece 120, as shown in FIGS. 1A and 1B, in order to control a magnetic flux more effectively.

The springs 160 are a type of elastic means for providing elastic force to push the base 140 away from the first pole piece 110 and the second pole piece 120. In addition to the springs 160 in this exemplary embodiment, other elastic materials such as rubber and polyurethane may be used as the elastic means.

The control device (not shown) controls current applied to the coil 150 to thereby control holding and detaching operations of the magnetic substance holding device 100 according to this exemplary embodiment.

Hereinafter, the principle will be described that the magnetic substance holding device 100 thus configured holds and detaches a workpiece 1, which is a magnetic substance.

Referring to FIG. 1A, a workpiece 1 is attached on the holding faces 111 and 121 of the first pole piece 110 and the second pole piece 120, with no current applied to the coil 150. The primary permanent magnet 130 magnetizes the first pole piece 110 and the second pole piece 120, and thus attractive force acts between the first pole piece 110 and the work piece 1 and between the second pole piece 120 and the workpiece 1. As a result, the workpiece 1 is attached on the holding faces 111 and 121 and thus a magnetic flux indicated by the dashed line is created. Accordingly, the workpiece 1 is firmly attached on the magnetic substance holding device 100.

As the first pole piece 110 and the second pole piece 120 are magnetized by the primary permanent magnet 130, attractive force acts, of course, between the base 130 and the first pole piece 110/the second pole piece 120 as well. However, the springs 160 push up the base 140 so as not to allow the base 140 to attach to the first pole piece 110 and the second pole piece 120.

Accordingly, the base 140 is placed at the first location at which it maintains a constant distance form the first pole piece 110 and the second pole piece 120. Consequently, no or almost no magnetic flux flow is created toward the base 140. Therefore, majority of the magnetic force generated from the primary permanent magnet 130 flows through the workpiece 1, and thus the workpiece is held very firmly on the magnetic substance holding device 100.

In this regard, holding force can be enhanced by applying current to the coil 150 so that the N-pole is created on the lower side of FIG. 1A. As such, by applying current to the coil 150, the second pole piece 120 is magnetized by electromagnetic induction as if it were an electromagnet, so that stronger magnetic force can be obtained.

Now, referring to FIG. 1B, detaching the workpiece 1 from the magnetic substance holding device 100 will be described.

As shown in FIG. 1B, when electric current is applied to the coil 150 so that an N-pole is created close to the primary permanent magnet 140, magnetic force attracting the base 140 is enhanced, so that the base 140 overcomes the elastic force by the springs 160 to be attached on the base-attaching faces 112 and 122. Namely, the base 140 is placed at the second location.

The base 140 is attached to the base-attaching faces 112 and 122, and accordingly a magnetic flux is created passing through the primary permanent magnet 130, the second pole piece 120, the base 140, the first pole piece 110, and the primary permanent magnet 130. Further, the coil 150 induces a magnetic flux of the permanent magnet 130 toward the base 140 other than the workpiece 1, so that no magnetic flux flows through the workpiece 1.

Consequently, the workpiece 1 can be detached from the holding face 111 of the first pole piece 110 and the holding face 121 of the second pole piece 120. Then, the base 140 does not return to the first location even if applying of the current to the coil 150 is interrupted. Accordingly, the magnetic flux flow passing through the base 140 is maintained, so that the workpiece 1 cannot be attached on the holding faces 111 and 121.

To hold the workpiece 1 again, it is necessary to apply electric current in the direction opposite to that indicated in FIG. 1B to the coil 150 so as to return the base 140 to the first location shown in FIG. 1 by the elastic force by the springs 160. Namely, the strength of the magnetic flux as indicated by the dashed line shown in FIG. 1B is weakened by using the coil 150, so that the base 140 can be returned to the first location.

In this connection, the elastic coefficient of the springs 160 needs to be adjusted appropriately. For example, if the elastic coefficient of the springs 160 is too small, after the base 140 is attached to the first pole piece 110 and the second pole piece 120, substantial amount of electric current has to be supplied to the coil 150 in order to return the base 140 to the first location. On the contrary, if the elastic coefficient of the springs 160 is too large, substantial amount of electric current has to be supplied to the coil 150 in order to attach the base 140 to the base-attaching faces 112 and 122 at the time of detaching the workpiece 1, which is not preferable. The appropriate elastic coefficient of the springs 160 may be determined empirically or experimentally, taking into account the strength of the magnetic force induced by the coil 150 or the like.

In addition to the elastic coefficient of the springs 160, the separation distance by which the base 140 at the first location is spaced apart from the base-attaching faces 112 and 122 also has to be determined appropriately. If the distance is too distant, the base 140 may not be attached to the base-attaching faces 112 and 122 even when electric current is applied to the coil 150. On the other hand, if the distance is too close, the base 140 may be attached to the base-attaching faces 112 and 122 even when electric current is not applied to the coil 150. Therefore, in view of the above, the separation distance between the base 140 at the first location and the base-attaching faces 112 and 122 has to be adjusted such that the base 140 is attached to the base-attaching faces 112 and 122 only when certain amount of electric current is applied to the coil 150. The distance may be adjusted empirically or experimentally, taking into account the strength of the magnetic force induced by the coil 150, the elastic coefficient of the springs 160 or the like.

Once appropriate separation distance is determined, the determined separation distance can be easily set by means of the bolts 141 screwed into the first pole piece 110 and the second pole piece 120.

Hereinafter, structures for minimizing residual magnetism in the magnetic substance holding device 100 according to this exemplary embodiment will be described in detail.

To block residual magnetism effectively, flow-promoting portions 113 and 123 may be formed. The flow-promoting portions 113 and 123 is to avoid that when the base 140 is at the second location shown in FIG. 1B, the shortest one of magnetic flux paths (as indicated by the dashed line) induced by the primary permanent magnet 130 and passing through the base 140 is bent at a right angle. The flow-promoting portions 113 and 123 include a first flow-promoting portion 113 formed near a region where the first pole piece 110 meets the base 140, and a second flow-promoting portion 123 formed near a region where the second pole piece 120 meets the base 140. The shortest magnetic flux path in FIG. 1B refers to a path along the inner peripheral surface of each of the base 140, the first pole piece 110, the second pole piece 120 and the primary permanent magnet 130. If the first pole piece 110 meets the base 140 at a right angle, and the second pole piece 120 meets the base 140 at a right angle, the shortest magnetic flux path is bent at a right angle, so that the magnetic flux flow is disturbed. In contrast, with the flow-promoting portions 113 and 123, the length of the magnetic flux paths become shorter and the width thereof becomes larger, so that the reluctance to the magnetic flux flow is reduced. As a result, the magnetic flux flow toward the base 140 is promoted, whereas the magnetic flux flow toward the workpiece 1 is suppressed while the workpiece is detached as shown in FIG. 1B. As a result, residual magnetism can be reduced.

Although the flow-promoting portions 113 and 123 are formed as parts of the first pole piece 110 and the second pole piece 120, respectively, in this exemplary embodiment, the flow-promoting portions 113 and 123 may be formed as parts of the base 110. Further, although the inner peripheral surfaces of the flow-promoting portions 113 and 123 have straight surfaces in this exemplary embodiment, it is more preferable that the inner peripheral surfaces may have curved surfaces conforming to the magnetic flux flow.

Another way to further reduce residual magnetism is to have the corners of the base 140 chamfered or filleted as shown in FIGS. 1A and 1B. At a right-angle corner which is neither chamfered nor filleted, magnetic eddy current may occur when the magnetic flux flow is created as shown in FIG. 1B. This works as reluctance to the magnetic flux flow or adversely affects the efficiency. In contrast, with the chamfered or filleted corners as shown in FIGS. 1A and 1B, such magnetic eddy current does not occur and thus resistance to the magnetic flow can be further reduced. Therefore, by chamfering or filleting the corners of the base 140 so that the magnetic field flows along the path shown in FIG. 1B, residual magnetism can be further reduced.

Another way to further reduce residual magnetism will be described with reference to FIG. 2. FIG. 2 is a side cross-sectional view of the second pole piece 120, relative to the front view shown in FIG. 1A.

The second pole piece 120 may have the front shape shown in FIGS. 1A and 1B and have an elongated plate-like, side shape shown in FIG. 2. Namely, the second pole piece 120 may have a plate-like shape having a relatively large first face and a second face opposed to the first face. When the second pole piece 120 is viewed from a view point perpendicular to the first or second face as shown in FIG. 2, the upper face of the second pole piece 120 is the base-attaching face 122 and the lower face thereof is the holding face 121. In this instance, for reducing residual magnetism, as shown in FIG. 2, it is preferable that the horizontal width $W_1$ of the base-attaching face is smaller than the horizontal width $W_2$ of the portion around which the coil 150 is wound, and the horizontal width $W_3$ of the holding face 121 is equal to or smaller than the width $W_2$. This is because, with the relationship $W_1>W_2\geq W_3$, the reluctance to the magnetic flux flow toward the base 140 becomes smaller and accordingly residual magnetism is reduced. In addition, by having right-angle corners on both sides in the middle portion as shown in FIG. 2, eddy current occurs in the magnetic flux flowing downwardly, so that reluctance thereto becomes relatively large. Consequently, with at least one of the first pole piece 110 and the second pole piece 120 having the shape shown in FIG. 2, residual magnetism can be further reduced.

Another way to further reduce residual magnetism is to make the area of the holding face 110 of the first pole piece 111 smaller than the average of the cross-sectional area of the portion where the primary permanent magnet 130 faces the first pole piece 110. (i.e., the average of the cross-sectional areas of the first pole piece taken from the lower side to the upper side in FIG. 1A) Likewise, the area of the holding face 121 of the second pole piece 120 is made smaller than the average of the cross-sectional area of the portion where the primary permanent magnet 130 faces the second pole piece 120. With this configuration, magnetic resistance in the path from the portion where the flow of the magnetic field is generated (where the primary permanent magnet 130 meets the pole pieces) to the holding faces 111 and 121 is increased so that residual magnetism does not flow toward the holding faces 111 and 121. As a result, residual magnetism is suppressed.

In order not to overly restrict holding force, as shown in FIGS. 1A and 1B, it is preferable to make the inner peripheral surfaces of the first pole piece 110 and the second pole piece 120 straight surfaces while making steps on the outer peripheral surfaces thereof.

Another way to further reduce residual magnetism is to make the average cross-sectional area of the base 140 in the longitudinal direction larger than the average cross-sectional area of the portion where the primary permanent magnet 130 faces the first pole piece 110, and larger than the average cross-sectional area of the portion where the primary permanent magnet 130 faces the second pole piece 130. Namely, in FIGS. 1A and 1B, by making the base 140 thicker than the portions where the first pole piece 110 and the second pole piece 120 face the primary permanent magnet 130 to reduce resistance to the magnetic flow toward the base 140, residual magnetism toward the lower side can be suppressed.

Figure 3A:
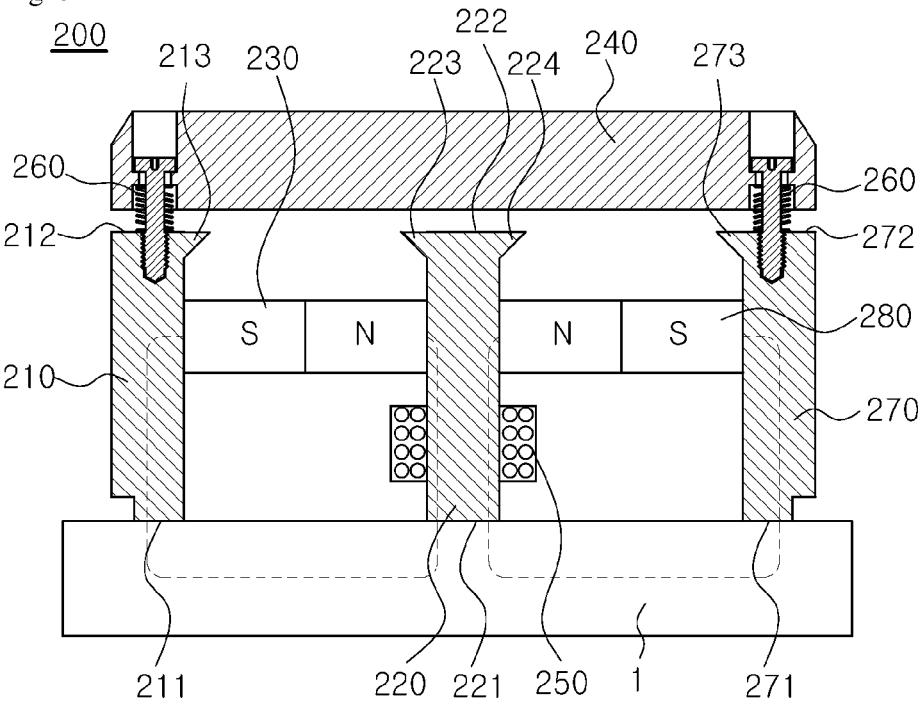
FIGS. 3A and 3B are schematic cross-sectional views of a magnetic substance holding device according to another exemplary embodiment of the present invention.
Figure 3B:
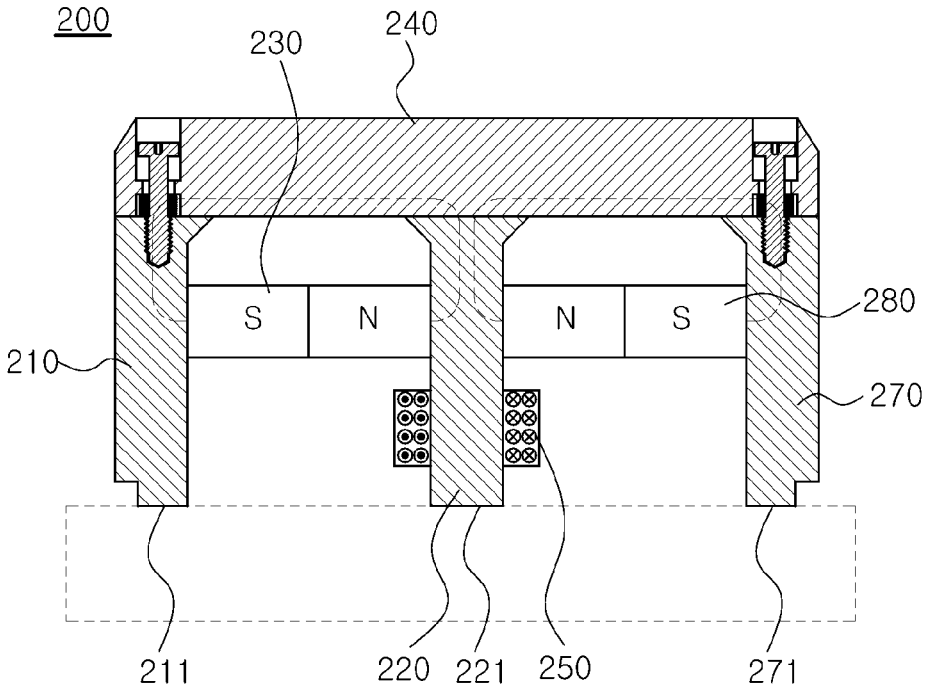

FIGS. 3A and 3B are schematic cross-sectional views of a magnetic substance holding device according to another exemplary embodiment of the present invention. Specifically, FIG. 3A is a schematic cross-sectional view of the magnetic substance holding device when it holds a workpiece, whereas FIG. 3B is a schematic cross-sectional view of the magnetic substance holding device when a workpiece is detached therefrom.

Referring to FIGS. 3A and 3B, a magnetic substance holding device 200 according to this exemplary embodiment includes a first pole piece 210, a second pole piece 220, a primary permanent magnetic 230, a base 240, a coil 250, a spring 260, a third pole piece 270, an auxiliary permanent magnet 280, and a control device (not shown).

The magnetic substance holding device 200 according to this exemplary embodiment employs basically the same operating principle as that of the magnetic substance holding device 100 shown in FIGS. 1A and 1B; and, therefore, descriptions will be made focusing on the differences.

The magnetic substance holding device 200 according to this exemplary embodiment further includes the third pole piece 270 and the auxiliary permanent magnet 280 in addition to the elements included in the magnetic substance holding device 100 shown in FIGS. 1A and 1B. Further, the base 240 is extended relative to the base 140 to attach to and detach from the third pole piece 260. Other elements, such as the first pole piece 210, the second pole piece 220, the primary permanent magnet 230, the coil 250 and the springs 260 are identical to the first pole piece 110, the second pole piece 120, the primary permanent magnet 130, the coil 150 and the springs 160 shown in FIGS. 1A and 1B, respectively.

The third pole piece 270 has a holding face 271 on which a workpiece 1 is to be attached, and a base-attaching face 272 on the opposite end to the holding face 271. The third pole piece 270 is made of a magnetic substance.

The auxiliary permanent magnet 280 is disposed so that its one pole of the same polarity as that of the primary permanent magnet 230 in contact with second pole piece 220 is in contact with the second pole piece 220 while its other pole is in contact with the third pole piece 270.

In this exemplary embodiment, the coil 250 is wound around the second pole piece 220. In addition to this, coils may be wound around at least one of the first pole piece 210 and the third pole piece 270.

In this exemplary embodiment, the first location of the base 240 refers to the location where at least two of the base-attaching face 212 of the first pole piece 210, the base-attaching face 222 of the second pole piece 220 and the base-attaching face 272 of the third pole piece 270 are spaced apart from the base 240, as shown in FIG. 3A.

In addition, in this exemplary embodiment, the second location of the base 240 refers to the location where all of the base-attaching face 212 of the first pole piece 210, the base-attaching face 222 of the second pole piece 220 and the base-attaching face 272 of the third pole piece 270 come in contact with the base 240, as shown in FIG. 3B.

By placing the base 240 at the first location, a workpiece 1 can be attached on the holding faces 211, 221 and 271 of the first pole piece 210, the second pole piece 220 and the third pole piece 270.

Further, by applying electric current to the coil 250 in the direction shown in FIG. 3B, a magnetic flux is created passing through the base-attaching face 212 of the first pole piece 210, the base-attaching face 222 of the second pole piece 220 and the base-attaching face 272 of the third pole piece 270, so that the base 240 is placed at the second location by the magnetic force to thereby detach the workpiece 1 from the holding faces 211, 221 and 271.

The structure for minimizing residual magnetism can be applied to the third pole piece 270 as well. Namely, a flow-promoting portion 273 may be formed near a region where the third pole piece 270 meets the base 240 so that when the base 240 is at the second location shown in FIG. 3B, the shortest one of magnetic flux paths induced by the primary permanent magnet 230 and the auxiliary permanent magnet 280 and passing through the base 240 is not bent at a right angle. Another flow-promoting portion may be formed on the second pole piece 220 in addition to the flow-promoting portion 223.

Further, the corners of the base 240 are preferably chamfered or filleted for conforming to the magnetic flux paths induced by the primary permanent magnet 230 and the auxiliary permanent magnet 280 and passing though the base 240 when the base 240 is at the second location shown in FIG. 3B.

All other configurations described with respect to FIGS. 1A and 1B may be applied hereto; and, therefore, the redundant description will be omitted.

Figure 4A:
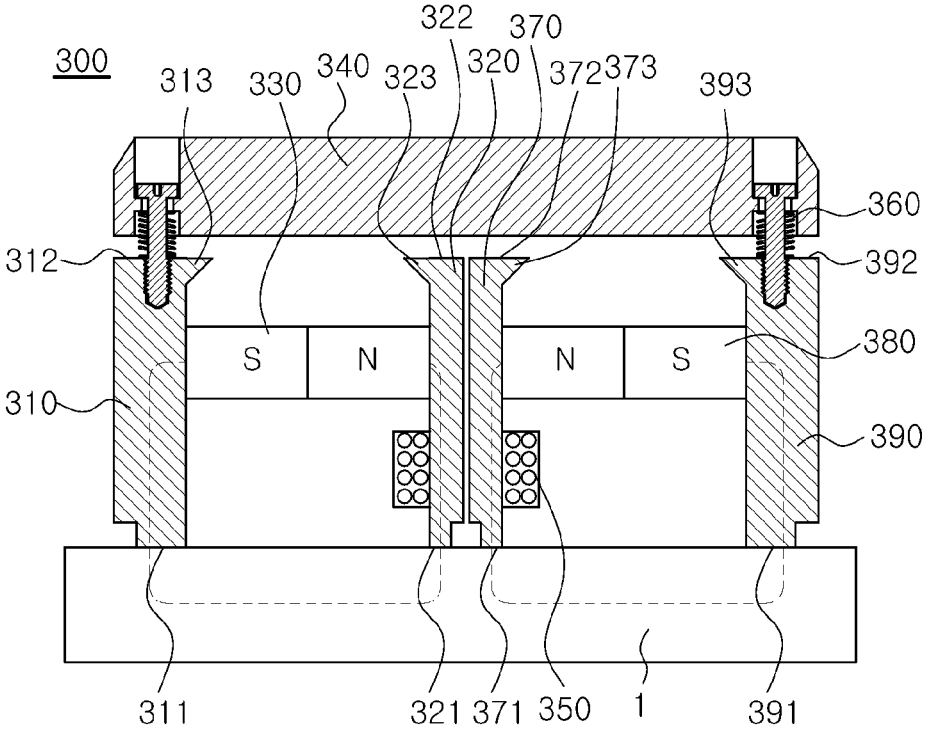
FIGS. 4A and 4B are schematic cross-sectional views of a magnetic substance holding device according to another exemplary embodiment of the present invention.
Figure 4B:
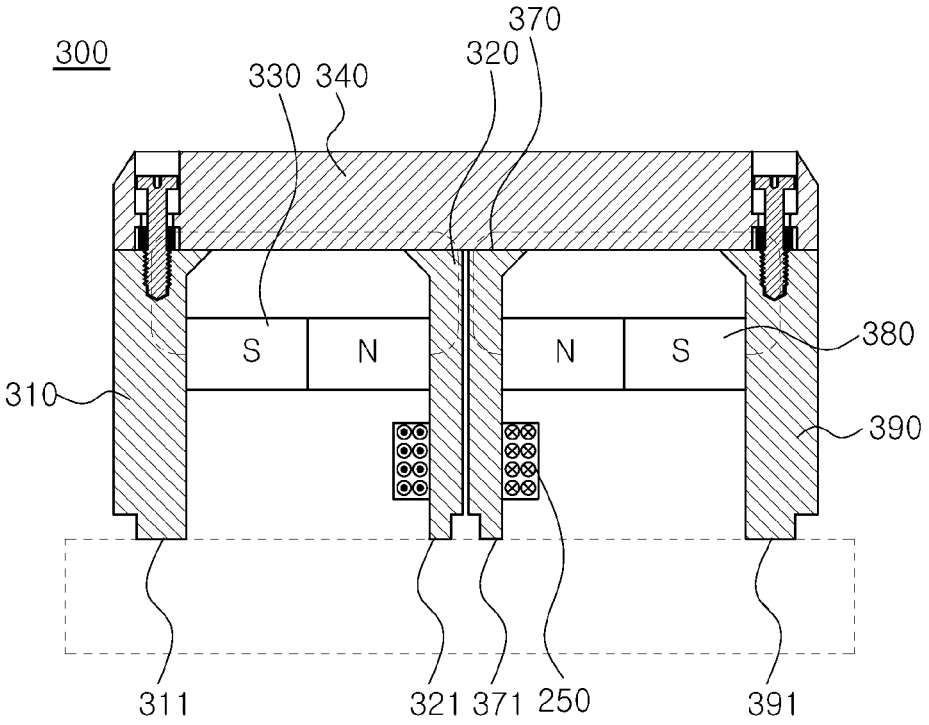

FIGS. 4A and 4B are schematic cross-sectional views of a magnetic substance holding device according to yet another exemplary embodiment of the present invention. Specifically, FIG. 4A is a schematic cross-sectional view of the magnetic substance holding device when it holds a workpiece, whereas FIG. 4B is a schematic cross-sectional view of the magnetic substance holding device when a workpiece is detached therefrom.

Referring to FIGS. 4A and 4B, a magnetic substance holding device 300 according to this exemplary embodiment includes a first pole piece 310, a second pole piece 320, a primary permanent magnetic 330, a base 340, a coil 350, a spring 360, a third pole piece 370, an auxiliary permanent magnet 380, a fourth pole piece 390 and a control device (not shown).

The magnetic substance holding device 300 according to this exemplary embodiment employs basically the same operating principle as that of the magnetic substance holding device 100 shown in FIGS. 1A and 1B; and, therefore, descriptions will be made focusing on the differences.

The magnetic substance holding device 300 according to this exemplary embodiment further includes the third pole piece 370, the auxiliary permanent magnet 380 and the fourth pole piece 390 in addition to the elements included in the magnetic substance holding device 100 shown in FIGS. 1A and 1B. Further, the base 340 is extended relative to the base 140 to attach to and detach from the third pole piece 370 and the fourth pole piece 390. Other elements, such as the first pole piece 310, the second pole piece 320, the primary permanent magnet 330, the coil 350 and the springs 360 are identical to the first pole piece 110, the second pole piece 120, the primary permanent magnet 130, the coil 150 and the springs 160 shown in FIGS. 1A and 1B, respectively.

The third pole piece 370 has a holding face 371 on which a workpiece 1 is to be attached, and a base-attaching face 372 on the opposite end to the holding face 371. The third pole piece 370 is made of a magnetic substance. Further, the third pole piece 370 is spaced apart from the second pole piece 320 facing each other.

The auxiliary permanent magnet 380 is disposed so that its one pole of the same polarity as that of the primary permanent magnet 330 in contact with second pole piece 320 is in contact with the third pole piece 370 while its other pole is in contact with the fourth pole piece 390.

The fourth pole piece 390 has a holding face 391 on which a workpiece 1 is to be attached, and a base-attaching face 392 on the opposite end to the holding face 391. The fourth pole piece 390 is made of a magnetic substance.

In this exemplary embodiment, the coil 350 is wound around the second pole piece 320 and the third pole piece 370 together. In addition to this, coils may also be wound around at least one of the first pole piece 31 and the fourth pole piece 390 and also around the base 340.

In this exemplary embodiment, the first location of the base 340 refers to the location where at least three of the base-attaching face 312 of the first pole piece 310, the base-attaching face 322 of the second pole piece 320, the base-attaching face 372 of the third pole piece 370 and the base-attaching face 392 of the fourth pole piece 390 are spaced apart from the base 340, as shown in FIG. 4A.

In addition, in this exemplary embodiment, the second location of the base 340 refers to the location where all of the base-attaching face 312 of the first pole piece 310, the base-attaching face 322 of the second pole piece 320, the base-attaching face 372 of the third pole piece 370 and the base-attaching face 392 of the fourth pole piece 390 come in contact with the base 340, as shown in FIG. 4B.

By placing the base 340 at the first location, a workpiece 1 can be attached on the holding faces 311, 321, 371 and 391 of the first pole piece 310, the second pole piece 320, the third pole piece 370 and the fourth pole piece 390.

Further, by applying electric current to the coil 350 in the direction shown in FIG. 4B, a magnetic flux is created passing through the base-attaching face 312 of the first pole piece 310, the base-attaching face 322 of the second pole piece 320, the base-attaching face 372 of the third pole piece 370 and the base-attaching face 392 of the fourth pole piece 390, so that the base 340 is placed at the second location by the magnetic force to thereby detach the workpiece 1 from the holding faces 311, 321, 371 and 391.

The structure for minimizing residual magnetism can be applied to the third pole piece 370 and the fourth pole piece 390 as well. Namely, flow-promoting portions 373 and 393 may be formed near a region where the third pole piece 370 meets the base 340 or a region where the fourth pole piece 390 meets the base 340 so that when the base 340 is at the second location shown in FIG. 4B, the shortest one of magnetic flux paths induced by the primary permanent magnet 330 and the auxiliary permanent magnet 380 and passing through the base 340 is not bent at a right angle.

Further, the corners of the base 340 are preferably chamfered or filleted for conforming to the magnetic flux paths induced by the primary permanent magnet 330 and the auxiliary permanent magnet 380 and passing though the base 340 when the base 340 is at the second location shown in FIG. 4B.

All other configurations described with respect to FIGS. 1A and 1B may be applied hereto; and, therefore, the redundant description will be omitted.

Figure 5A:
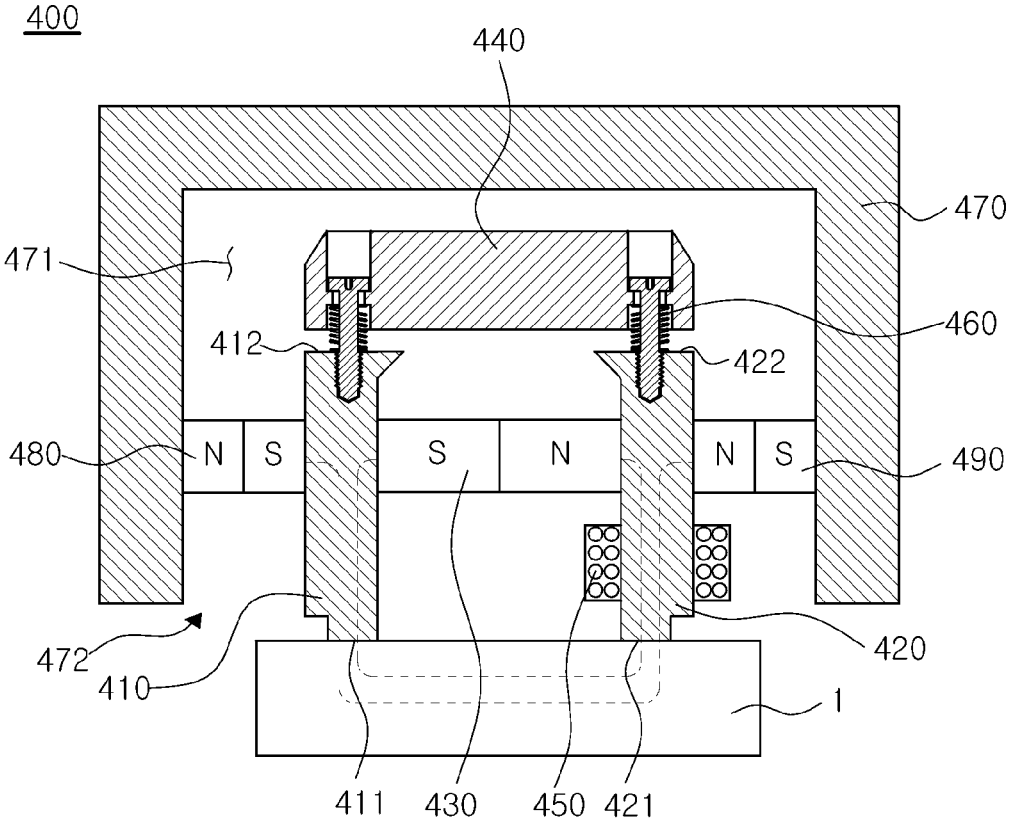
FIGS. 5A and 5B are schematic cross-sectional views of a magnetic substance holding device according to yet another exemplary embodiment of the present invention.
Figure 5B:
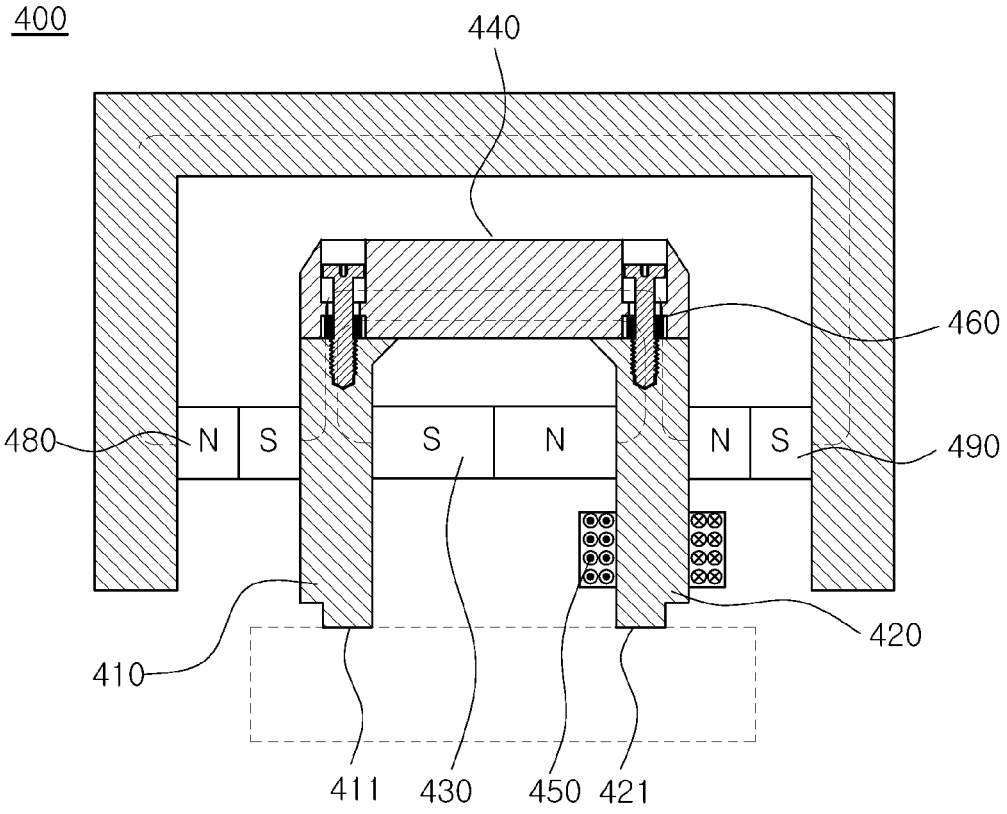

FIGS. 5A and 5B are schematic cross-sectional views of a magnetic substance holding device according to yet another exemplary embodiment of the present invention. Specifically, FIG. 5A is a schematic cross-sectional view of the magnetic substance holding device when it holds a workpiece, whereas FIG. 5B is a schematic cross-sectional view of the magnetic substance holding device when a workpiece is detached therefrom.

Referring to FIGS. 5A and 5B, a magnetic substance holding device 400 according to this exemplary embodiment includes a first pole piece 410, a second pole piece 420, a primary permanent magnetic 430, a base 440, a coil 450, springs 460, a yoke 470, a first auxiliary permanent magnet 480, a second auxiliary permanent magnet 490, and a control device (not shown).

The magnetic substance holding device 400 according to this exemplary embodiment employs basically the same operating principle as that of the magnetic substance holding device 100 shown in FIGS. 1A and 1B; and, therefore, descriptions will be made focusing on the differences.

The magnetic substance holding device 400 according to this exemplary embodiment further includes the yoke 470, the first auxiliary permanent magnet 480, the second auxiliary permanent magnet 490, in addition to the elements included in the magnetic substance holding device 100 shown in FIGS. 1A and 1B. Other elements, such as the first pole piece 410, the second pole piece 420, the primary permanent magnet 430, the base 440, the coil 450 and the springs 460 are identical to the first pole piece 110, the second pole piece 120, the primary permanent magnet 130, the base 140, the coil 150 and the springs 160 shown in FIGS. 1A and 1B, respectively.

The yoke 470 has an accommodation space 471 therein and an opening 472, and made of a magnetic substance. As shown in FIGS. 5A and 5B, at least a part of each of the base 440, the first pole piece 410 and the second pole piece 420 is accommodated in the accommodation space 471 while being spaced apart from the yoke 470. The yoke 470 and the base 440 may be spaced apart from each other without any additional member interposed therebetween, or with a paramagnetic substance therebetween such as aluminum.

The first auxiliary permanent magnet 480 is disposed so that its one pole of the same polarity as that of the primary permanent magnet 430 in contact with first pole piece 410 is in contact with the first pole piece 410 while its other pole is in contact with the yoke 470.

The second auxiliary permanent magnet 490 is disposed so that its one pole of the same polarity as that of the primary permanent magnet 430 in contact with second pole piece 420 is in contact with the second pole piece 420 while its other pole is in contact with the yoke 470.

A holding face 411 of the first pole piece 410 and a holding face 421 of the second pole piece 420 are exposed to the outside through the opening 472 of the yoke 470.

In this exemplary embodiment, an additional magnetic flux flow is created through the yoke 470 as shown in FIG. 5B at the time of detaching a workpiece, so that residual magnetism can be more effectively reduced. Additionally, by virtue of the first auxiliary permanent magnetic 480 and the second auxiliary permanent magnetic 490, stronger holding force can be obtained.

All other configurations described with respect to FIGS. 1A and 1B may be applied hereto; and, therefore, the redundant description will be omitted.

FIGS. 6A and 6B are schematic cross-sectional views of a magnetic substance holding device according to yet another exemplary embodiment of the present invention. Specifically, FIG. 6A is a schematic cross-sectional view of the magnetic substance holding device when it holds a workpiece, whereas FIG. 6B is a schematic cross-sectional view of the magnetic substance holding device when a workpiece is detached therefrom.

Referring to FIGS. 6A and 6B, a magnetic substance holding device 500 according to this exemplary embodiment includes a first pole piece 510, a second pole piece 520, a primary permanent magnetic 530, a base 540, a coil 550, a yoke 570, a first auxiliary permanent magnet 580, a second auxiliary permanent magnet 590, and a control device (not shown).

The magnetic substance holding device 500 according to this exemplary embodiment employs basically the same operating principle as that of the magnetic substance holding device 100 shown in FIGS. 1A and 1B; and, therefore, descriptions will be made focusing on the differences.

The magnetic substance holding device 500 according to this exemplary embodiment further includes the yoke 570, the first auxiliary permanent magnet 580, the second auxiliary permanent magnet 590, in addition to the elements included in the magnetic substance holding device 100 shown in FIGS. 1A and 1B. Other elements, such as the first pole piece 510, the second pole piece 520, the primary permanent magnet 530 and the base 540 are identical to the first pole piece 110, the second pole piece 120, the primary permanent magnet 130 and the base 140 shown in FIGS. 1A and 1B, respectively.

The yoke 570 has an accommodation space 571 therein and an opening 572, and made of a magnetic substance. As shown in FIGS. 6A and 6B, the base 540, the first pole piece 510 and the second pole piece 520 are accommodated in the accommodation space 571, and the first pole piece 510 and the second pole piece 520 are spaced apart from the yoke 570.

The first auxiliary permanent magnet 580 is disposed so that its one pole of the same polarity as that of the primary permanent magnet 530 in contact with first pole piece 510 is in contact with the first pole piece 510 while its other pole is in contact with the yoke 570.

The second auxiliary permanent magnet 590 is disposed so that its one pole of the same polarity as that of the primary permanent magnet 530 in contact with second pole piece 520 is in contact with the second pole piece 520 while its other pole is in contact with the yoke 570.

A holding face 510 of the first pole piece 511 and a holding face 520 of the second pole piece 521 are exposed to the outside through the opening 570 of the yoke 572.

In this exemplary embodiment, the springs 160 shown in FIGS. 1A and 1B are eliminated. When the base 540 is at the first location as shown in FIG. 6A, the base 540 is spaced apart from both of the base-attaching face 512 of the first pole piece 510 and the base-attaching face 522 of the second pole piece 520 while it comes in contact with a pair of projections 573 and 574 formed inside the yoke 570. When the base 540 is at the second location as shown in FIG. 6B, the base 540 is spaced apart from the pair of projections 573 and 574 while it comes in contact with both of the base-attaching face 512 and the base-attaching face 522.

As such, the base 540 can be switched between the first location and the second location as it moves between the base-attaching faces 512 and 522 and the pair of the projections 573 and 574. It is to be noted that this exemplary embodiment does not exclude disposing springs between the base 540 and the base-attaching faces 512 and 522.

In addition, unlike the above-described exemplary embodiments, the coil 550 is wound around the base 540. This is because it is advantageous to magnetize the base 540 to change the magnetic flux flow for the vertical movement of the base 540. However, the coil 540 may be wound around at least one of the first pole piece 510 and the second pole piece 520 in addition to the base 540.

In this exemplary embodiment, an additional magnetic flux flow is created through the yoke 570 as shown in FIG. 6B at the time of detaching a workpiece, so that residual magnetism can be more effectively reduced. Additionally, by virtue of the first auxiliary permanent magnetic 480 and the second auxiliary permanent magnetic 490, stronger holding force can be obtained. Further, by eliminating springs, the magnetic substance holding device can have a simpler structure.

All other configurations described with respect to FIGS. 1A and 1B may be applied hereto; and, therefore, the redundant description will be omitted.

Figure 7A:
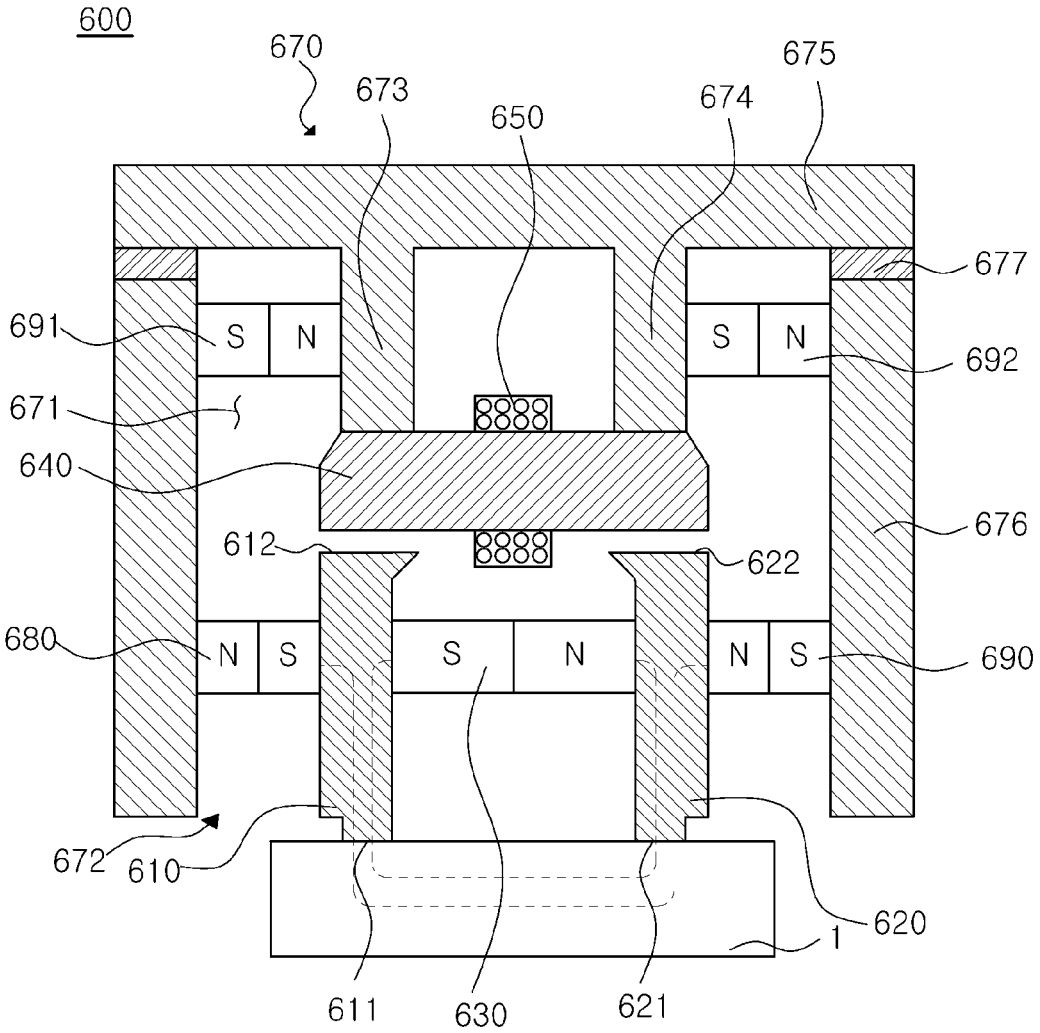
FIGS. 7A and 7B are schematic cross-sectional views of a magnetic substance holding device according to yet another exemplary embodiment of the present invention.
Figure 7B:
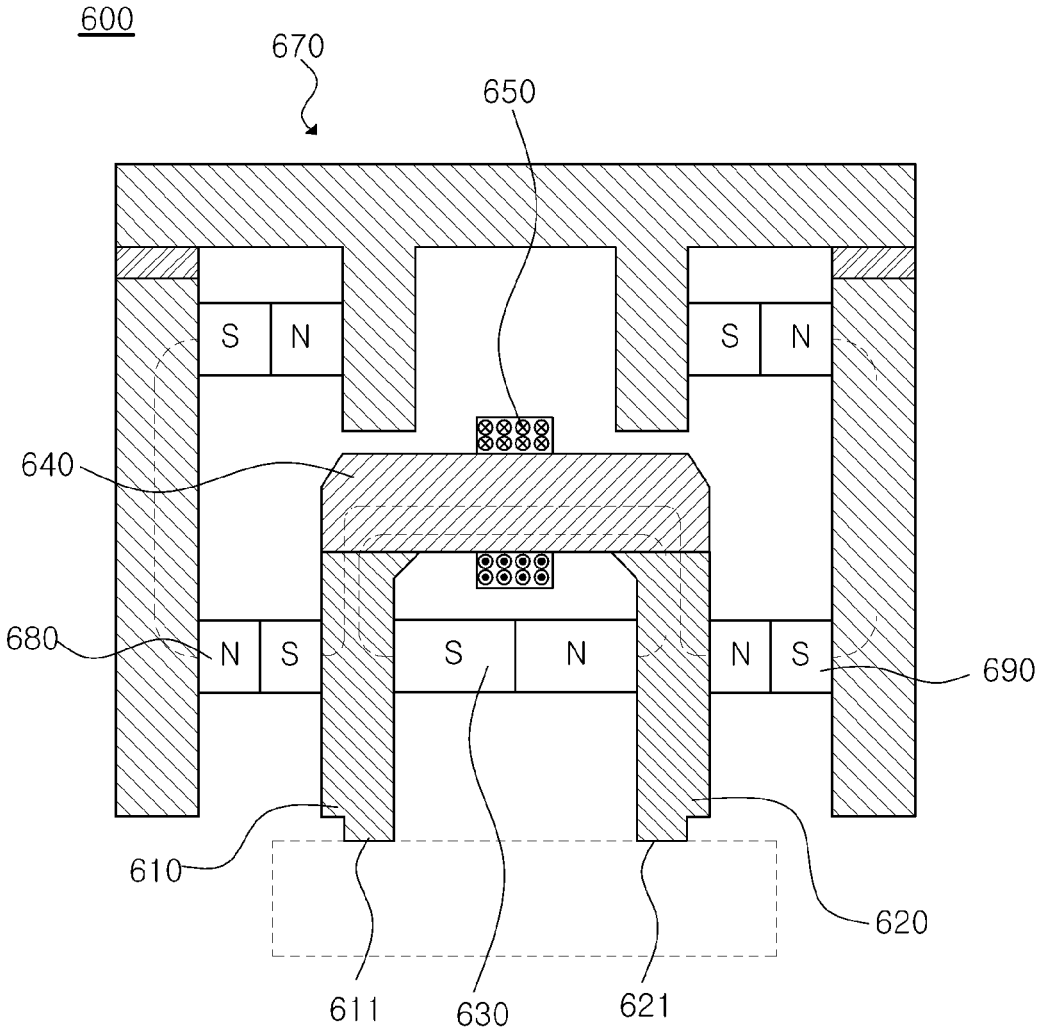

FIGS. 7A and 7B are schematic cross-sectional views of a magnetic substance holding device according to still another exemplary embodiment of the present invention. Specifically, FIG. 7A is a schematic cross-sectional view of the magnetic substance holding device when it holds a workpiece, whereas FIG. 7B is a schematic cross-sectional view of the magnetic substance holding device when a workpiece is detached therefrom.

Referring to FIGS. 7A and 7B, a magnetic substance holding device 600 according to this exemplary embodiment includes a first pole piece 610, a second pole piece 620, a primary permanent magnetic 630, a base 640, a coil 650, a yoke 670, a first auxiliary permanent magnet 680, a second auxiliary permanent magnet 690, a third auxiliary permanent magnet 691, a fourth auxiliary permanent magnet 692 and a control device (not shown).

The magnetic substance holding device 600 according to this exemplary embodiment employs basically the same operating principle as that of the magnetic substance holding device 500 shown in FIGS. 6A and 6B; and, therefore, descriptions will be made focusing on the differences.

The magnetic substance holding device 600 according to this exemplary embodiment further includes the third auxiliary permanent magnet 691, and the fourth auxiliary permanent magnet 692 in addition to the elements included in the magnetic substance holding device 500 shown in FIGS. 6A and 6B. Further, there is a difference in that the yoke 670 comprises a bottom plate 675 and side plates 676 spaced apart from the bottom plate 675. Other elements, such as the first pole piece 610, the second pole piece 620, the primary permanent magnet 630, the base 640 and the coil 650 are identical to the first pole piece 510, the second pole piece 520, the primary permanent magnet 530, the base 540 and the coil 540 shown in FIGS. 6A and 6B, respectively.

The yoke 670 comprises the bottom plate 675 and side plates 676. The bottom plate 675 and the side plates 676 may be spaced apart from each other or may have paramagnet substances 677 such as aluminum therebetween as shown in FIG. 7A. Further, the first auxiliary permanent magnet 680 and the second auxiliary permanent magnet 690 may be in contact with the side plates 676.

The first projection 673 and the second projection 674, which are magnetic substances, protrude from the bottom plate 675 toward the accommodation space 671. The first projection 673 and the second projection 674 correspond to the projections 573 and 574 shown in FIGS. 6A and 6B, respectively.

The third auxiliary permanent magnet 691 is disposed so that its one pole of the opposite polarity to that of the first auxiliary permanent magnet 680 in contact with first pole piece 610 is in contact with the first projection 673 while its other pole of the same polarity as that of the first auxiliary permanent magnet 680 in contact with the first pole piece 610 is in contact with the respective side plate 676.

The fourth auxiliary permanent magnet 692 is disposed so that its one pole of the opposite polarity to that of the second auxiliary permanent magnet 690 in contact with second pole piece 620 is in contact with the second projection 674 while its other pole of the same polarity as that of the second auxiliary permanent magnet 690 in contact with the second pole piece 620 is in contact with the respective side plate 676.

In this exemplary embodiment, by virtue of the first auxiliary permanent magnetic 480 and the second auxiliary permanent magnetic 490, stronger holding force can be obtained. Further, by eliminating springs, the magnetic substance holding device can have a simpler structure. Further, by virtue of the magnetic force induced by the third auxiliary permanent magnet 691 and the fourth auxiliary permanent magnet 692, stronger holding force can be obtained than the magnetic substance holding device 500 shown in FIGS. 6A and 6B.

All other configurations described with respect to FIGS. 1A and 1B and FIGS. 6A and 6B may be applied hereto; and, therefore, the redundant description will be omitted.

Figure 8A:
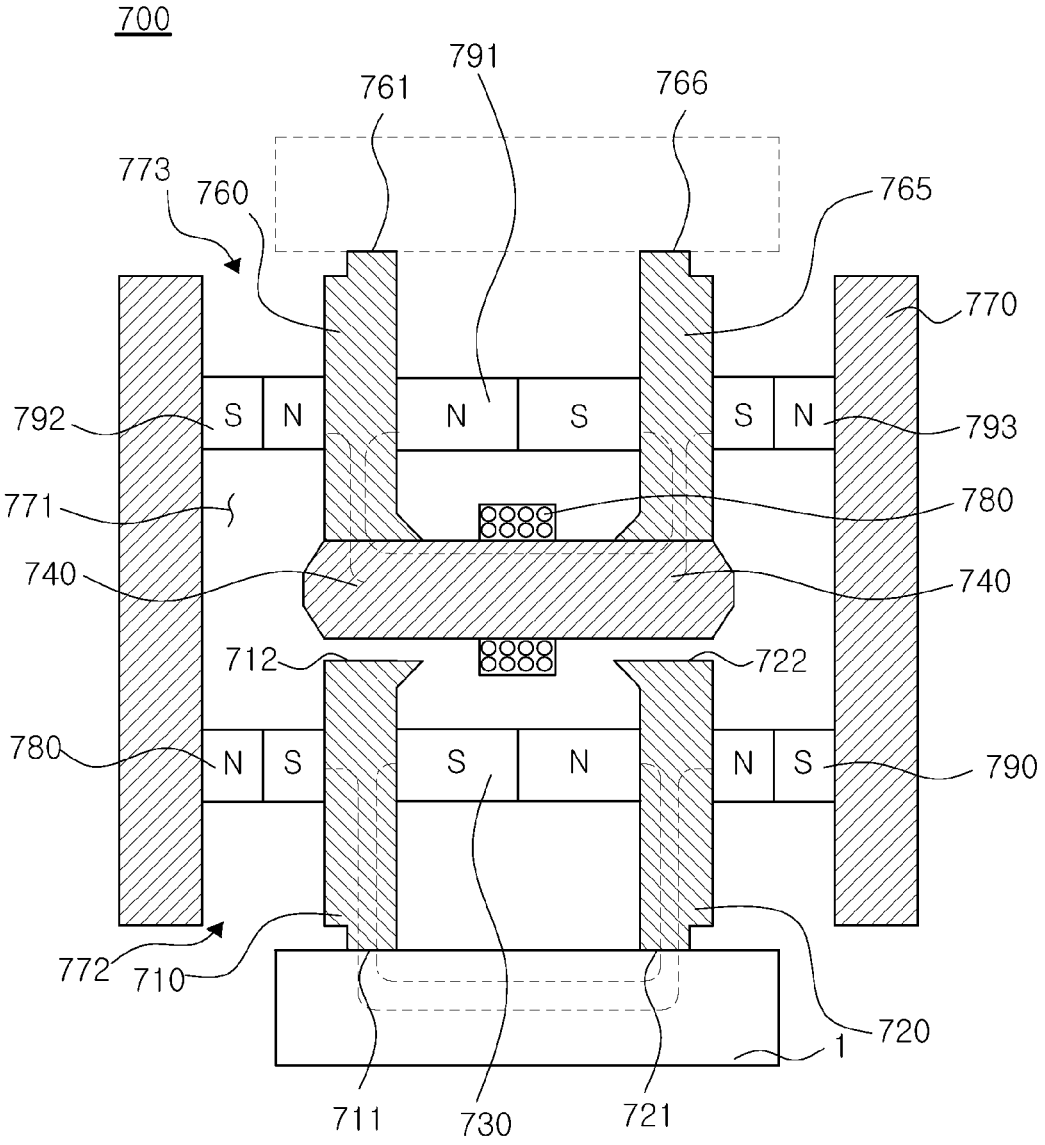
FIGS. 8A and 8B are schematic cross-sectional views of a magnetic substance holding device according to still another exemplary embodiment of the present invention.
Figure 8B:
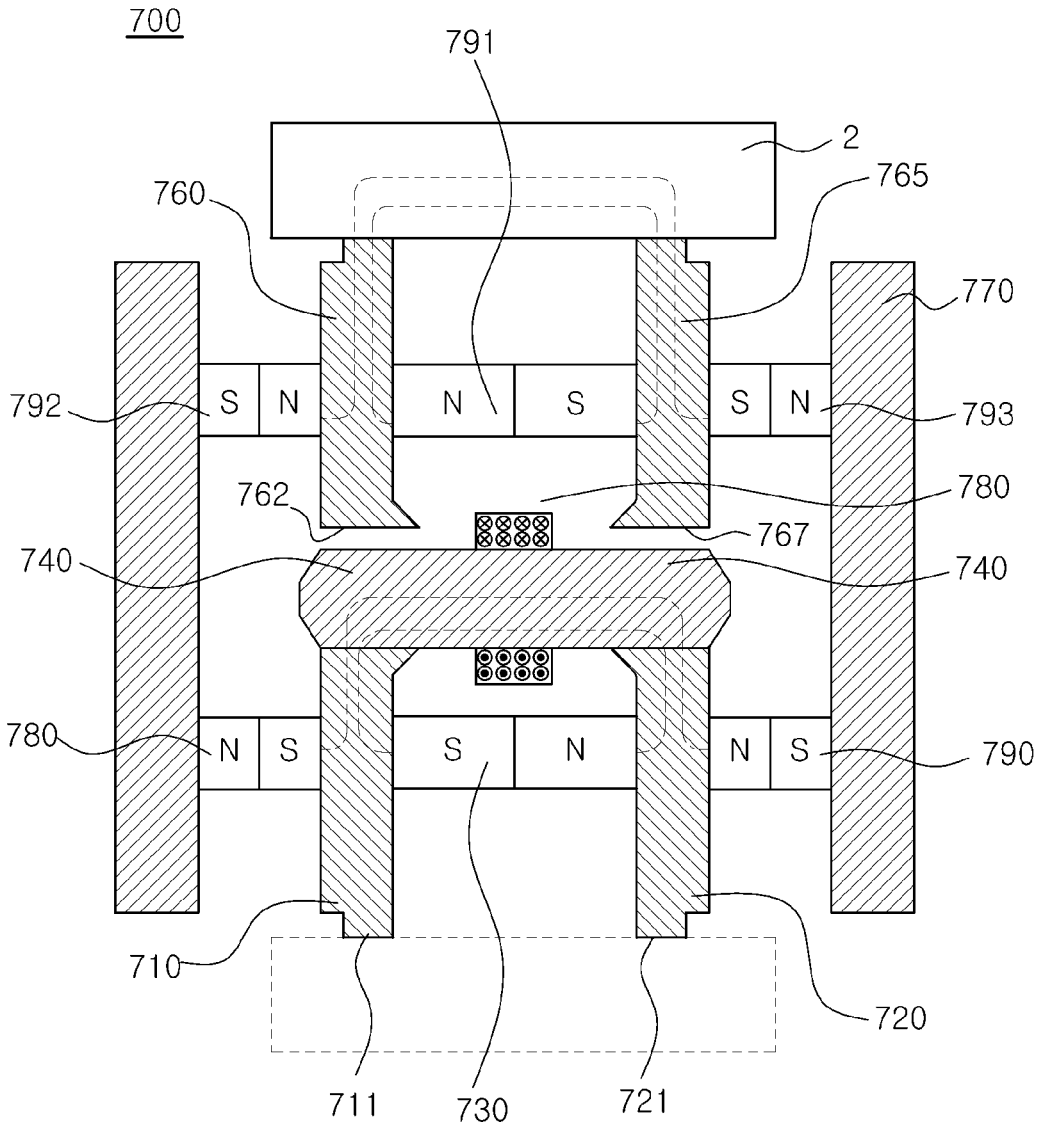

FIGS. 8A and 8B are schematic cross-sectional views of a magnetic substance holding device according to yet another exemplary embodiment of the present invention. Specifically, FIG. 8A is a schematic cross-sectional view of the magnetic substance holding device when it holds a workpiece and detaches another workpiece, whereas FIG. 8B is a schematic cross-sectional view of the magnetic substance holding device when it detaches the workpiece and attaches another workpiece.

Referring to FIGS. 8A and 8B, a magnetic substance holding device 700 according to this exemplary embodiment includes a first pole piece 710, a second pole piece 720, a primary permanent magnetic 730, a base 740, a coil 750, a third pole piece 760, a fourth pole piece 765, a yoke 770, a first auxiliary permanent magnet 780, a second auxiliary permanent magnet 790, a third auxiliary permanent magnet 791, a fourth auxiliary permanent magnet 792, a fifth auxiliary permanent magnet and a control device (not shown).

The magnetic substance holding device 700 according to this exemplary embodiment employs basically the same operating principle as that of the magnetic substance holding device 100 shown in FIGS. 1A and 1B; and, therefore, descriptions will be made focusing on the differences.

The magnetic substance holding device 700 according to this exemplary embodiment further includes the third pole piece 760, the fourth pole piece 765, the yoke 770, the first auxiliary permanent magnet 780, the second auxiliary permanent magnet 790, the third auxiliary permanent magnet 791, the fourth auxiliary permanent magnet 792 and the fifth auxiliary permanent magnet 793, in addition to the elements included in the magnetic substance holding device 100 shown in FIGS. 1A and 1B. Other elements, such as the first pole piece 710, the second pole piece 720, the primary permanent magnet 730 and the base 740 are identical to the first pole piece 110, the second pole piece 120, the primary permanent magnet 130 and the base 140 shown in FIGS. 1A and 1B, respectively.

The third pole piece 760 has a holding face 761 on which a workpiece 2 different from the workpiece 1 is to be attached, and a base-attaching face 762 at different portion from the holding face 761. The third pole piece 760 is made of a magnetic substance.

The fourth pole piece 765 has a holding face 766 on which the workpiece 2 different from the workpiece 1 is to be attached, and a base-attaching face 767 at different portion from the holding face 766. The fourth pole piece 765 is made of a magnetic substance.

The yoke 770 has an accommodation space 771 therein and openings 772 and 773 on at least two sides, and is made of a magnetic substance. The opening 772 is for attaching the workpiece 1 while the opening 773 is for attaching the other workpiece 2.

The first auxiliary permanent magnet 780 is disposed so that its one pole of the same polarity as that of the primary permanent magnet 730 in contact with first pole piece 710 is in contact with the first pole piece 710 while its other pole is in contact with the yoke 770.

The second auxiliary permanent magnet 790 is disposed so that its one pole of the same polarity as that of the primary permanent magnet 730 in contact with second pole piece 720 is in contact with the second pole piece 720 while its other pole is in contact with the yoke 770.

The third auxiliary permanent magnet 791 is disposed so that its one pole of the same polarity as that of the primary permanent magnet 730 in contact with second pole piece 720 is in contact with the third pole piece 760 while its other pole is in contact with the fourth pole piece 765.

The fourth auxiliary permanent magnet 792 is disposed so that its one pole of the same polarity as that of the third auxiliary permanent magnet 791 in contact with third pole piece 760 is in contact with the third pole piece 760 while its other pole is in contact with the yoke 770.

The fifth auxiliary permanent magnet 793 is disposed so that its one pole of the same polarity as that of the third auxiliary permanent magnet 791 in contact with fourth pole piece 765 is in contact with the fourth pole piece 765 while its other pole is in contact with the yoke 770.

A holding face 711 of the first pole piece 710 and a holding face 721 of the second pole piece 720 are exposed to the outside through the opening 772, and a holding face 761 of the third pole piece 760 and a holding face 766 of the fourth pole piece 765 are exposed to the outside through the opening 773.

The first location of the base 740 refers to the location where the base 740 is spaced apart from the base-attaching face 712 of the first pole piece 710 and the base-attaching face 722 of the second pole piece 720 while it comes in contact with and the base-attaching face 762 of the third pole piece 760 and the base-attaching face 767 of the fourth pole piece 765 (see FIG. 8A).

Further, the second location of the base 740 refers to the location where the base 740 is spaced apart from the base-attaching face 762 of the third pole piece 760 and the base-attaching face 767 of the fourth pole piece 765 while it comes in contact with the base-attaching face 712 of the first pole piece 710 and the base-attaching face 722 of the second pole piece 720 (see FIG. 8B).

When the base 740 is at the first location as shown in FIG. 8A, the workpiece 1 is attached on the device whereas the workpiece 2 is detached from the device. In this instance, residual magnetism toward the other workpiece 2 may be mitigated by the magnetic flux flow through the yoke 770 and the base 740.

In addition, when the base 740 is at the second location as shown in FIG. 8B, the workpiece 1 is detached from the device whereas the workpiece 2 is attached to the device. In this instance, residual magnetism toward the workpiece 1 may be mitigated by the magnetic flux flow through the yoke 770 and the base 740.

The magnetic substance holding device 700 according to this exemplary embodiment can be used for alternately attaching and detaching plural workpieces 1 and 2.

All other configurations described with respect to FIGS. 1A and 1B may be applied hereto; and, therefore, the redundant description will be omitted.

According to the magnetic substance holding devices 100 to 700 of the present invention, residual magnetism can be minimized at the time of detaching a workpiece. Such reduction in residual magnetism is achieved by minimizing reluctance to the magnetic flux flow toward the base thank to the above-described structure (so-called water-flow structures) of the base, the first pole piece, the second pole piece, the third pole piece or the fourth pole piece.

Hereinafter, the effect of reducing residual magnetism by the magnetic substance holding devices of the present invention will be described in terms of numerical values. Experiments for measuring actual numerical values were conducted using the above-described magnetic substance holding device 200. The experiments were conducted with a magnetic material holding device in the first experimental condition and a magnetic material holding device in the second experimental condition. Each of the magnetic substance holding devices has the configuration as described below:

The magnetic substance holding device in the first experimental condition: the magnetic substance holding device 200 in FIG. 3A, without employing the structures for minimizing residual magnetism. Namely, neither the flow-promoting portions 213 and 223 are formed nor the corners of the base 240 are chamfered or filleted.

The magnetic substance holding device in the second experimental condition: the magnetic substance holding device 200 in FIG. 3A, as it is.

With the above two magnetic substance holding devices, residual magnetism when a workpiece was detached therefrom was measured as holding force, as shown in the table below. Note that for all of the two magnetic material holding devices, the ratios of holding force at the time of detaching to holding force at the time of holding were calculated on the assumption that the later is 300 kgf.

TABLE 1

| | First Experimental Condition | Second Experimental Condition |
|---|---|---|
| Holding Force (kgf) at The Time of Detaching | 5.5~8 | 0~2.5 |
| Ratio of Holding Force at the Time of Detaching to Holding Force at the Time of Holding (%) | 1.8~2.7 | 0~0.8 |

As can be seen from Table 1, by employing the structure for minimizing residual magnetism according to the present invention, the holding force by residual magnetism is reduced to 0% to 0.8% relative to the holding force at the time of holding. Therefore, the magnetic substance holding devices 100 to 700 of the present invention can reduce holding force by residual magnetism to almost zero. Further, as residual magnetism is minimized, more permanent magnets can be disposed, so that holding force at the time of holding can be increased.

Although the exemplary embodiments of the present invention have been described with reference to the accompanying drawings, those skilled in the art would understand that various modifications and alterations may be made without departing from the technical idea or essential features of the present invention. Therefore, it should be understood that the above-mentioned embodiments are not limiting but illustrative in all aspects.

What is claimed is:

1. A magnetic substance holding device for holding and detaching a workpiece, the workpiece being a magnetic substance, the device comprising:

a first pole piece having a holding face on which the workpiece is attached and a base-attaching face at different portion from the holding face, the first pole piece being a magnetic substance;

a second pole piece having a holding face on which the workpiece is attached and a base-attaching face at different portion from the holding face, the second pole piece being a magnetic substance;

a primary permanent magnet disposed so that its N-pole comes in contact with one of the first pole piece and the second pole piece while its S-pole comes in contact with the other of the first pole piece and the second pole piece;

a base configured to move between a first location and a second location, the base being spaced apart from at least one of the base-attaching face of the first pole piece and the base-attaching face of the second pole piece at the first location while the base being in contact with both of the base-attaching face of the first pole piece and the base-attaching face of the second pole piece at the second location;

at least one coil wound around at least one of the first pole piece, the second pole piece and the base; and a control device controlling electric current applied to the coil to magnetize at least one of the first pole piece, the second pole piece and the base, thereby controlling holding or detaching of the workpiece, wherein, upon the base being placed at the first location, the workpiece is attached on the holding faces of the first and second pole pieces, wherein, upon applying electric current to the coil to create magnetic flux flow passing through the base-attaching face of the first pole piece and the base-attaching face of the second pole piece, the base is placed at the second location by magnetic force, so that the workpiece is detached from the holding faces of the first and second pole pieces, wherein a flow-promoting portion is formed near a region where the first pole piece meets the base or a region where the second pole piece meets the base so that when the base is at the second location, the shortest one of magnetic flux paths induced by the primary permanent magnet and passing through the base is not bent at a right angle, and wherein corners of the base are chamfered or filleted for conforming to magnetic flux path induced by the primary permanent magnet and passing though the base when the base is at the second location.

2. The device of claim 1, further comprising:

a third pole piece having a holding face on which the workpiece is attached and a base-attaching face at different portion from the holding face, the third pole piece being a magnetic substance; and an auxiliary permanent magnet disposed so that its one pole of the same polarity as that of the primary permanent magnet in contact with the second pole piece is in contact with the second pole piece while its other pole is in contact with the third pole piece;

wherein the first location refers to a location of the base where at least two of the base-attaching face of the first pole piece, the base-attaching face of the second pole piece and the base-attaching face of the third pole piece are spaced apart from the base, wherein the second location refers to a location of the base where all of the base-attaching face of the first pole piece, the base-attaching face of the second pole piece and the base-attaching face of the third pole piece come in contact with the base, wherein the coil is wound around at least the second pole piece, wherein, upon the base being placed at the first location, the workpiece is attached on the holding faces of the first, second and third pole pieces, wherein upon applying electric current to the coil to create magnetic flux flow passing through the base-attaching face of the first pole piece, the base-attaching face of the second pole piece and the base-attaching face of the third pole piece, the base is placed at the second location by magnetic force, so that the workpiece is detached from the holding faces of the first, second and third pole pieces, wherein a flow-promoting portion is formed near a region where the third pole piece meets the base so that when the base is at the second location, the shortest one of magnetic flux paths induced by the primary permanent magnet and the auxiliary permanent magnet and passing through the base is not bent at a right angle, and wherein corners of the base are chamfered or filleted for conforming to magnetic flux path induced by the primary permanent magnet and the auxiliary permanent magnet and passing though the base when the base is at the second location.

3. The device of claim 1, further comprising:

a third pole piece having a holding face on which the workpiece is attached and a base-attaching face at different portion from the holding face, the third pole piece facing the second pole piece while being spaced apart therefrom, and being a magnetic substance;

a fourth pole piece having a holding face on which the workpiece is attached and a base-attaching face at different portion from the holding face; and an auxiliary permanent magnet disposed so that its one pole of the same polarity as that of the primary permanent magnet in contact with the second pole piece is in contact with the third pole piece while its other pole is in contact with the fourth pole piece, wherein the first location of the base refers to a location where at least three of the base-attaching face of the first pole piece, the base-attaching face of the second pole piece, the base-attaching face of the third pole piece and the base-attaching face of the fourth pole piece are spaced apart from the base, wherein the second location of the base refers to a location where all of the base-attaching face of the first pole piece, the base-attaching face of the second pole piece, the base-attaching face of the third pole piece and the base-attaching face of the fourth pole piece come in contact with the base, wherein the coil is wound around at least the second pole piece and the third pole piece together, wherein, upon the base being placed at the first location, the workpiece is attached on the holding faces of the first, second, third and fourth pole pieces, wherein, upon applying electric current to the coil to create magnetic flux flow passing through the base-attaching face of the first pole piece, the base-attaching face of the second pole piece, the base-attaching face of the third pole piece and the base-attaching face of the fourth pole piece, the base is placed at the second location by magnetic force, so that the workpiece is detached from the holding faces of the first, second, third and fourth pole pieces, wherein a flow-promoting portion is formed near a region where the third pole piece meets the base or a region where the fourth pole piece meets the base so that when the base is at the second location, the shortest one of magnetic flux paths induced by the primary permanent magnet and the auxiliary permanent magnet and passing through the base is not bent at a right angle, and wherein corners of the base are chamfered or filleted for conforming to magnetic flux path induced by the primary permanent magnet and the auxiliary permanent magnet and passing though the base when the base is at the second location.

4. The device of claim 1, further comprising:

a yoke having an accommodation space therein and an opening, the yoke being a magnetic substance;

a first auxiliary permanent magnet disposed so that its one pole of the same polarity as that of the primary permanent magnet in contact with the first pole piece is in contact with the first pole piece while its other pole is in contact with the yoke; and a second auxiliary permanent magnet disposed so that its one pole of the same polarity as that of the primary permanent magnet in contact with the second pole piece is in contact with the second pole piece while its other pole is in contact with the yoke, wherein at least a part of the base, the first pole piece and the second pole piece is accommodated in the accommodation space of the yoke while being spaced apart from the yoke, and wherein the holding faces of the first pole piece and the second pole piece are exposed to the outside through the opening.

5. The device of claim 1, further comprising:

a yoke having an accommodation space therein and an opening, the yoke being a magnetic substance;

a first auxiliary permanent magnet disposed so that its one pole of the same polarity as that of the primary permanent magnet in contact with the first pole piece is in contact with the first pole piece while its other pole is in contact with the yoke; and a second auxiliary permanent magnet disposed so that its one pole of the same polarity as that of the primary permanent magnet in contact with the second pole piece is in contact with the second pole piece while its other pole is in contact with the yoke, wherein at least a part of each of the base, the first pole piece and the second pole piece is accommodated in the accommodation space of the yoke, the first pole piece and the second pole piece being spaced apart from the yoke, wherein the base is spaced apart from the yoke when it is at the second location, wherein the base is spaced apart from both of the base-attaching face of the first pole piece and the base-attaching face of the second pole piece but is in contact with the yoke when it is at the first location, and wherein the holding faces of the first pole piece and the second pole piece are exposed to the outside through the opening.

6. The device of claim 5, wherein the yoke comprises a bottom plate and side plates spaced apart from the bottom plate, the first auxiliary permanent magnet and the second auxiliary permanent magnet being in contact with the side plates, wherein the bottom plate has first and second projections protruding therefrom toward the accommodation space, wherein a third auxiliary permanent magnet is disposed between the first projection and one of the side plates so that its one pole of the opposite polarity to that of the first auxiliary permanent magnet in contact with first pole piece is in contact with the first projection while its other pole of the same polarity as that of the first auxiliary permanent magnet in contact with the first pole piece is in contact with the side plate, and wherein a fourth auxiliary permanent magnet is disposed between the second projection and the other one of the side plates so that its one pole of the opposite polarity to that of the second auxiliary permanent magnet in contact with second pole piece is in contact with the second projection while its other pole of the same polarity as that of the second auxiliary permanent magnet in contact with the second pole piece is in contact with the side plate.

7. The device of claim 1, further comprising:

a yoke having an accommodation space therein and at least two openings, the yoke being a magnetic substance;

a third pole piece having a holding face on which a different workpiece from the workpiece is attached and a base-attaching face at different portion from the holding face, the third pole piece being a magnetic substance;

a fourth pole piece having a holding face on which the different workpiece from the workpiece is attached and a base-attaching face at different portion from the holding face, the fourth pole piece being a magnetic substance;

a first auxiliary permanent magnet disposed so that its one pole of the same polarity as that of the primary permanent magnet in contact with the first pole piece is in contact with the first pole piece while its other pole is in contact with the yoke;

a second auxiliary permanent magnet disposed so that its one pole of the same polarity as that of the primary permanent magnet in contact with the second pole piece is in contact with the second pole piece while its other pole is in contact with the yoke;

a third auxiliary permanent magnet disposed so that its one pole of the same polarity as that of the primary permanent magnet in contact with the second pole piece is in contact with the third pole piece while its other pole is in contact with the fourth pole piece;

a fourth auxiliary permanent magnet disposed so that its one pole of the same polarity as that of the third auxiliary permanent magnet in contact with the third pole piece is in contact with the third pole piece while its other pole is in contact with the yoke; and a fifth auxiliary permanent magnet disposed so that its one pole of the same polarity as that of the third auxiliary permanent magnet in contact with the fourth pole piece is in contact with the fourth pole piece while its other pole is in contact with the yoke, wherein at least a part of each of the base, the first pole piece, the second pole piece, the third pole piece and the fourth pole piece is accommodated in the accommodation space of the yoke while being spaced apart from the yoke, wherein the holding faces of the first pole piece and the second pole piece are exposed to the outside through one of the openings, and the holding faces of the third pole piece and the fourth pole piece are exposed to the outside through the other one of the openings, wherein the first location of the base refers to a location of the base where both the base-attaching face of the first pole piece and the base-attaching face of the second pole piece are spaced apart from the base whereas both of the base-attaching face of the third pole piece and the base-attaching face of the fourth pole piece come in contact with the base, and wherein the second location of the base refers to a location of the base where both of the base-attaching face of the third pole piece and the base-attaching face of the fourth pole piece are spaced apart from the base.

8. The device of claim 1, wherein an area of the holding face of the first pole piece is smaller than an average of the cross-sectional area of the portion where the primary permanent magnet faces the first pole piece, and wherein an area of the holding face of the second pole piece is smaller than an average of the cross-sectional area of the portion where the primary permanent magnet faces the second pole piece.

9. The device of claim 1, wherein the second pole piece is in a plate-like shape having a relatively large first face and a second face, wherein the primary permanent magnet attaches to the first face and the coil is wound around between the primary permanent magnet and the holding face, and wherein when the second pole piece is disposed such that the upper face of the second pole piece is the base-attaching face and the lower face thereof is the holding face, from a point of view perpendicular to the first face, a horizontal width of the portion where the coil is wound is smaller than a horizontal width of the base-attaching face, and a horizontal width of the holding face is smaller than the horizontal width of the portion where the coil is wound.

10. The device of claim 1, wherein an average of cross-sectional areas of the base in a longitudinal direction is larger than an average of cross- sectional area of the portion where the primary permanent magnet faces the first pole piece, and larger than an average of the cross-sectional area of the portion where the primary permanent magnet faces the second pole piece.

11. The device of claim 1, further comprising: elastic means for providing elastic force to push the base away from the first pole piece and the second pole piece.

12. The device of claim 1, wherein the coil is wound around the first pole piece or the second pole piece and is disposed between the primary permanent magnet and the holding face.

13. The device of claim 1, wherein the coil is wound around the base.

* * * * *